US006912370B2

(12) United States Patent
Iwai

(10) Patent No.: US 6,912,370 B2
(45) Date of Patent: Jun. 28, 2005

(54) DUAL SIDED IMAGE PRINTING DEVICE AND METHOD

(75) Inventor: Sadayuki Iwai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 152 days.

(21) Appl. No.: 09/995,607

(22) Filed: Nov. 29, 2001

(65) Prior Publication Data

US 2002/0064404 A1 May 30, 2002

(30) Foreign Application Priority Data

Nov. 30, 2000 (JP) ..... 2000-365397
Sep. 20, 2001 (JP) ..... 2001-287513

(51) Int. Cl.[7] ..... G03G 15/16; G03G 15/20

(52) U.S. Cl. ..... 399/309; 399/69; 399/297; 399/308; 399/307

(58) Field of Search ..... 399/309, 308, 399/297, 401, 92, 307, 69

(56) References Cited

U.S. PATENT DOCUMENTS 4,212,529 A * 7/1980 O'Brien et al. ..... 399/401
4,214,831 A * 7/1980 Reesen ..... 399/401
4,291,970 A * 9/1981 DiFrancesco ..... 399/401
4,429,990 A * 2/1984 Tamary
4,436,404 A * 3/1984 Simmons et al. ..... 399/401
4,591,884 A * 5/1986 Miyamoto et al.
4,593,995 A * 6/1986 Holzhauser
4,714,939 A 12/1987 Ahern et al.
5,001,028 A * 3/1991 Mosehauer et al.
5,027,159 A * 6/1991 Oda et al. ..... 399/309
5,070,369 A * 12/1991 Mahoney et al. ..... 399/309
5,247,334 A * 9/1993 Miyakawa et al.
5,461,470 A 10/1995 DeCock et al.
5,519,484 A * 5/1996 Kumagai ..... 399/309
5,710,958 A * 1/1998 Raj
5,788,382 A * 8/1998 Egbert et al.
5,970,277 A * 10/1999 Shigeta et al. ..... 399/309
6,050,732 A * 4/2000 Tsusaka
6,064,848 A * 5/2000 Haneda ..... 399/308
6,269,237 B1 * 7/2001 Olbrich et al. ..... 399/401
6,308,034 B1 * 10/2001 Nakashima et al.
6,336,021 B1 * 1/2002 Nukada
6,411,318 B1 * 6/2002 Sawano et al.
6,493,106 B1 * 12/2002 Gauthier et al.

FOREIGN PATENT DOCUMENTS

JP 59077448 A * 5/1984 ..... G03G/9/12
JP 60-156071 * 8/1985
JP 61140423 A * 6/1986 ..... G03G/15/00
JP 03123364 A * 5/1991 ..... G03G/9/13
JP 05019642 A * 1/1993 ..... G03G/15/16
JP 5-35043 2/1993
JP 5-66630 3/1993
JP 7-72682 3/1995
JP 09160311 A * 6/1997 ..... G03G/15/00
JP 09244467 A * 9/1997 ..... G03G/15/22
JP 11-38692 * 2/1999
JP 11-160951 6/1999

OTHER PUBLICATIONS

U.S. Appl. No. 09/995,607, filed Nov. 29, 2001, Iwai.
U.S. Appl. No. 10/625,521, Jul. 24, 2003, Kosugi et al.
U.S. Appl. No. 09/995,607, filed Sep. 14, 2001, Iwai.
U.S. Appl. No. 10/448,029, filed May 30, 2003, Hirai et al.

* cited by examiner

*Primary Examiner*—Susan Lee
(74) *Attorney, Agent, or Firm*—Oblon, Spivak, McClelland, Maier & Neustadt, P.C.

(57) ABSTRACT

An image formation device for forming an image on an image supporting member by an image formation unit. The device includes first and second transfer units that transfer an image formed on the same image supporting member to a recording medium having front and back sides, and an inverting unit that inverts the front and back sides of the recording medium by an inverting path while conveying the recording medium from the first transfer unit to the second transfer unit. The inverting unit includes a branched nail and conveyance rollers.

73 Claims, 19 Drawing Sheets

DUAL SIDED IMAGE PRINTING DEVICE AND METHOD

FIELD OF THE INVENTION

The present invention relates to an image formation device, such as a color or monochrome copying machine, a printer, or the like, in various printing methods including the dry and wet electrophotography method, the ion flow method, the ink jet method, the toner jet method, the magnetography method, or the like.

BACKGROUND OF THE INVENTION

In view of the recent environmental issues and the energy saving limitation, dual sided printing is essential in a plain paper copy, a printer, or the like. In an ordinary dual sided printing system, a method of inverting the paper inside or outside the machine after printing one side, feeding the paper from a paper feeding section, and again printing the back side, is adopted. In this case, since only an exterior type inverting dual sided unit is needed, a simple configuration can be achieved as the machine configuration. However, the productivity in the case of dual sided printing, in particular, the productivity of first printing is drastically deteriorated compared with one side printing. Then, for example, systems disclosed in the Japanese patent Application Laid Open (JP-A) No. 5-35043, and the U.S. Pat. No. 5,461,470 are known. Those systems comprise a plurality of image producing devices for continuously dual sided printing.

In contrast, as a system for executing dual sided printing at the same time, the devices disclosed in the JP-A No. 11-160951, and the U.S. Pat. No. 4,714,939 are known. These devices are for transferring the image of a first surface onto the paper by inserting a paper between a photosensitive member and the intermediate transfer belt after temporarily copying a second surface image with the mirror image process applied on an intermediate transfer belt, and consecutively transferring the second surface image from the intermediate transfer belt to the paper back side at the paper separation position from the intermediate transfer belt.

However, according to the former system comprising a plurality of image producing devices for continuously executing dual sided printing, due to bulkiness of the machine and significant waste in the case of one side printing, it is used practically only in the high speed systems for business use.

Moreover, according to the latter system for transferring the image of a first surface onto the paper by inserting a paper between a photosensitive member and the intermediate transfer belt after temporarily copying a second surface image with the mirror image process applied on an intermediate transfer belt, and consecutively transferring the second surface image from the intermediate transfer belt to the paper back side at the paper separation position from the intermediate transfer belt, at the time of dual sided printing, since the intermediate transfer belt should make a round, the productivity is not high.

SUMMARY OF THE INVENTION

It is a first object of this invention to provide an image formation device capable of achieving high speed dual sided printing at a low cost with a high productivity.

It is a second object of this invention to provide an image formation method capable of achieving high speed dual sided printing at a low cost with a high productivity.

It is a third object of this invention to provide an image formation system capable of achieving high speed dual sided printing at a low cost with a high productivity.

In contrast, even in the case a high productivity and a low machine cost are achieved, further improvement is required in terms of responding to the recent demand for energy saving. Accordingly, a fourth object of this invention is to provide an image formation device, an image formation method, and an image formation system capable of achieving high speed dual sided printing while restraining the energy consumption.

In an image formation device according to the invention, there is provided an image formation device for forming an image by transferring an image formed on an image supporting member by an image formation unit, comprises first and a second transfer unit which transfers an image formed on the same image supporting member to a recording medium, and an inverting unit which inverts the front and back sides of the recording medium by an inverting path while conveying the recording medium from the first transfer unit to the second transfer unit.

An image formation method for forming an image by transferring an image formed on an image supporting member by an image formation unit, comprises an image formation step of forming a plurality of images on the image supporting member, a first transfer step of transferring one image on the image supporting member on a first surface of a recording medium, an inverting step of inverting the front and back sides of the recording medium with the image transferred onto the first surface at the first transfer step, and a second transfer step of transferring another image on the image supporting member onto a second surface of the recording medium with the front and back sides inverted at the inverting step.

There is provided an image formation system comprises an inputting device for inputting image data, and an image formation device for forming an image based on the inputted image data, wherein the image formation device comprises the image formation device according to the present invention as well as an image information memory unit which accumulates the image data inputted from the inputting device at least for one screen.

There is provided an image formation system comprises an inputting device for inputting image data, and an image formation device for forming an image based on the inputted image data, the inputting device comprises an image reading device for optically reading a manuscript as well as the image formation device comprises the image formation device according to the present invention, with the time for reading both surfaces of the manuscript of the image reading device set at the time for exposing the dual sided images on the image supporting member or less.

According to the configuration, the following characteristics can be provided,

1) Dual sided printing speed can be facilitated particularly in a machine using a revolver developing type transfer belt (dual sides are formed by taking two surfaces by one time image formation).
2) The first copy speed is substantially same in one side printing, and dual sided printing (only by the paper length in an inverting mechanism).
3) In the case of a tandem machine, since the feeding side paper interval can be substantially zero the productivity can be improved (because in the case of both printing, the paper is fed substantially alternately).
4) Since the paper is discharged with the face down, a paper inverting mechanism is not needed at the time of sorting output.

5) Since the fixation temperature for the first surface can be lowered to about the preliminary fixation so that shrinkage or elimination of the water content of the paper can be reduced, the second surface transfer can be preferable compared with an ordinary dual sided printing method.
6) Since the paper is preliminarily heated by the first surface fixation, the fixation consumption energy for the second surface can be reduced compared with an ordinary dual sided printing.
7) The fixation property is not so different for the first surface and the second surface at the time of dual sided printing, and the gloss degree is substantially same.
8) Both side printing for a thick paper can be dealt with.
9) In the case the wet electrophotography process is used, an occurrence of a fuzzy image can be reduced.
10) In the case the wet electrophotography process is used, fixation can be enabled only by drying, and thus the fixation cost can be restrained to a minimum level.

Other objects and features of this invention will become apparent from the following description with reference to the accompanying drawings.

DETAILED DESCRIPTION

Figure 1:
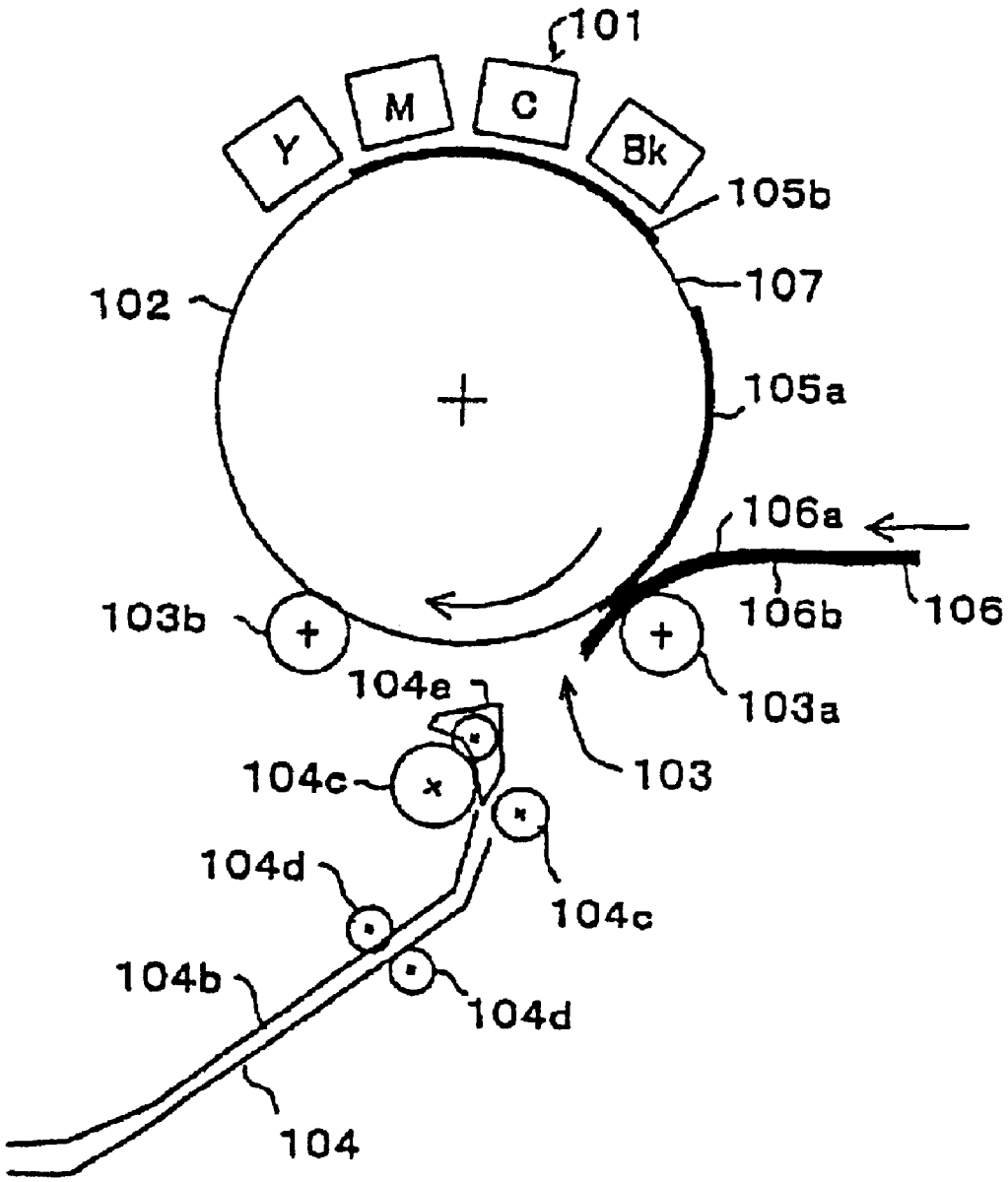
FIG. 1 is an explanatory diagram showing the concept of the prevent invention, in the state at the time of transfer by a first transfer unit.

Hereinafter, embodiments of the present invention will be explained with reference to the drawings. In the description below, equivalent parts are applied with the same reference numerals, and redundant explanation is optionally omitted.

1. Outline 1.1 Basic Concept

Figure 2:
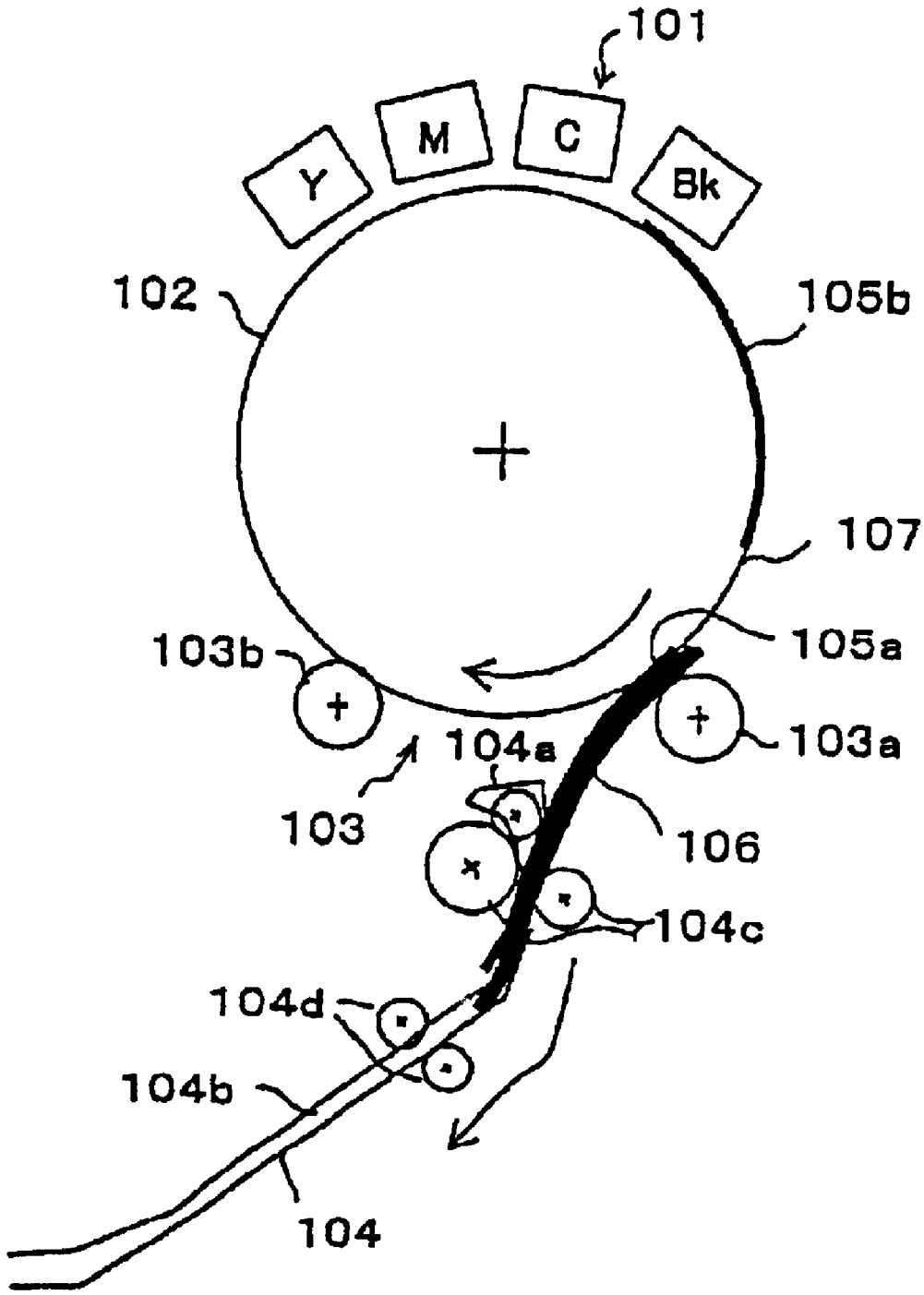
FIG. 2 is an explanatory diagram showing the concept of the present invention, in the state at the time of finishing the transfer by the first transfer unit.

FIGS. 1 and 2 are explanatory diagrams for explaining the concept of the present invention, showing an image formation section and an image transfer section schematically.

The image formation device shown in FIGS. 1 and 2 comprises an image formation section 101 for forming Y, M, C, Bk images, an image supporting member 102, a transfer section 103 for transferring an image at two points of the image supporting member, and an inverting section 104 for inverting a paper. The image formation section 101 having a function of continuously producing images 105*a*, 105*b* for dual sided printing on two surfaces (first surface, second surface) on the same image supporting member 102, transfers the images 105*a*, 105*b* on a first surface (front surface) 106*a* and a second surface (back surface) 106*b* of a paper 106 by first and second transfer sections 103*a*, 103*b*, respectively for the image supporting member 102. At the time, the paper 106 is inverted by the inverting section 104 while transferring images on the first surface 106*a* and the second surface 106*b* so as to enable the dual sided transfer.

As the image formation section, the dry electrophotography process using a dry toner is adopted in the first embodiment later described, and the wet electrophotography process using a wet toner is adopted in the second embodiment later described. Since these processes are same in principal except the developing method, explanation will be given hereafter for the case of the dry electrophotography process as an example.

Specifically, the images 105*a*, 105*b* for printing on the first surface 106*a* and the second surface 106*b* of the paper 106 are produced on the same image supporting member 102 continuously by a predetermined interval 107 (FIG. 1). The images are formed as a full color image by superimposing an image of each Y, M, C, or Bk color per one cycle of the image supporting member 102 driven by an unshown motor. Since various methods can be used as the image formation method as described later, explanation is not given here. Next, the image 105*a* for the first surface formed on the image supporting member 102 is transferred onto the first surface (front surface) 106*a* of the paper 106 by the first transfer section 103*a* (FIG. 1, FIG. 2). The image 105*a* for the first surface is transferred on the front surface 106*a* of the paper 106 passed through the first transfer section 103*a*. The transfer section 103 will be described later.

Figure 3:
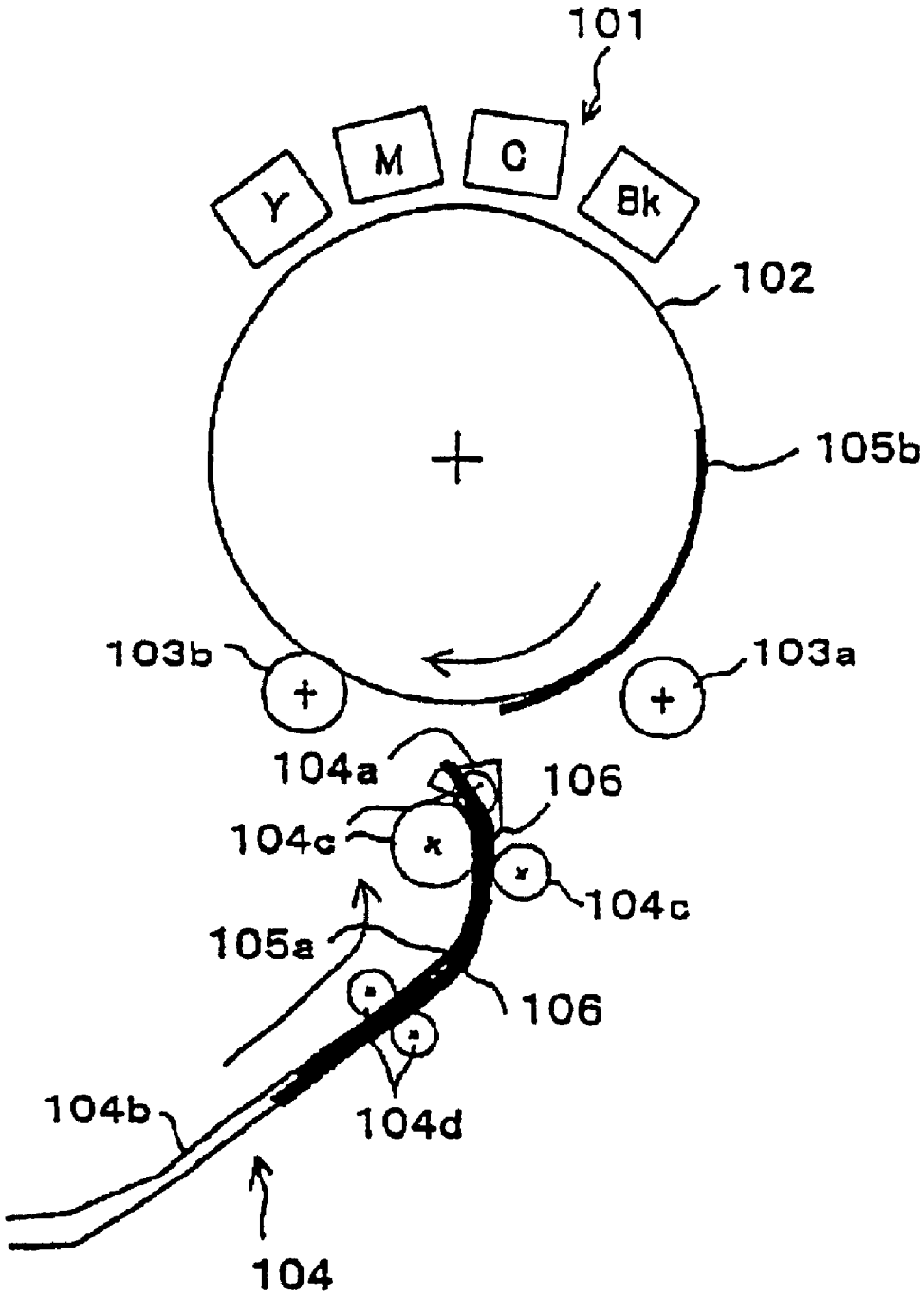
FIG. 3 is an explanatory diagram showing the concept of the present invention, of an inverting step.
Figure 4:
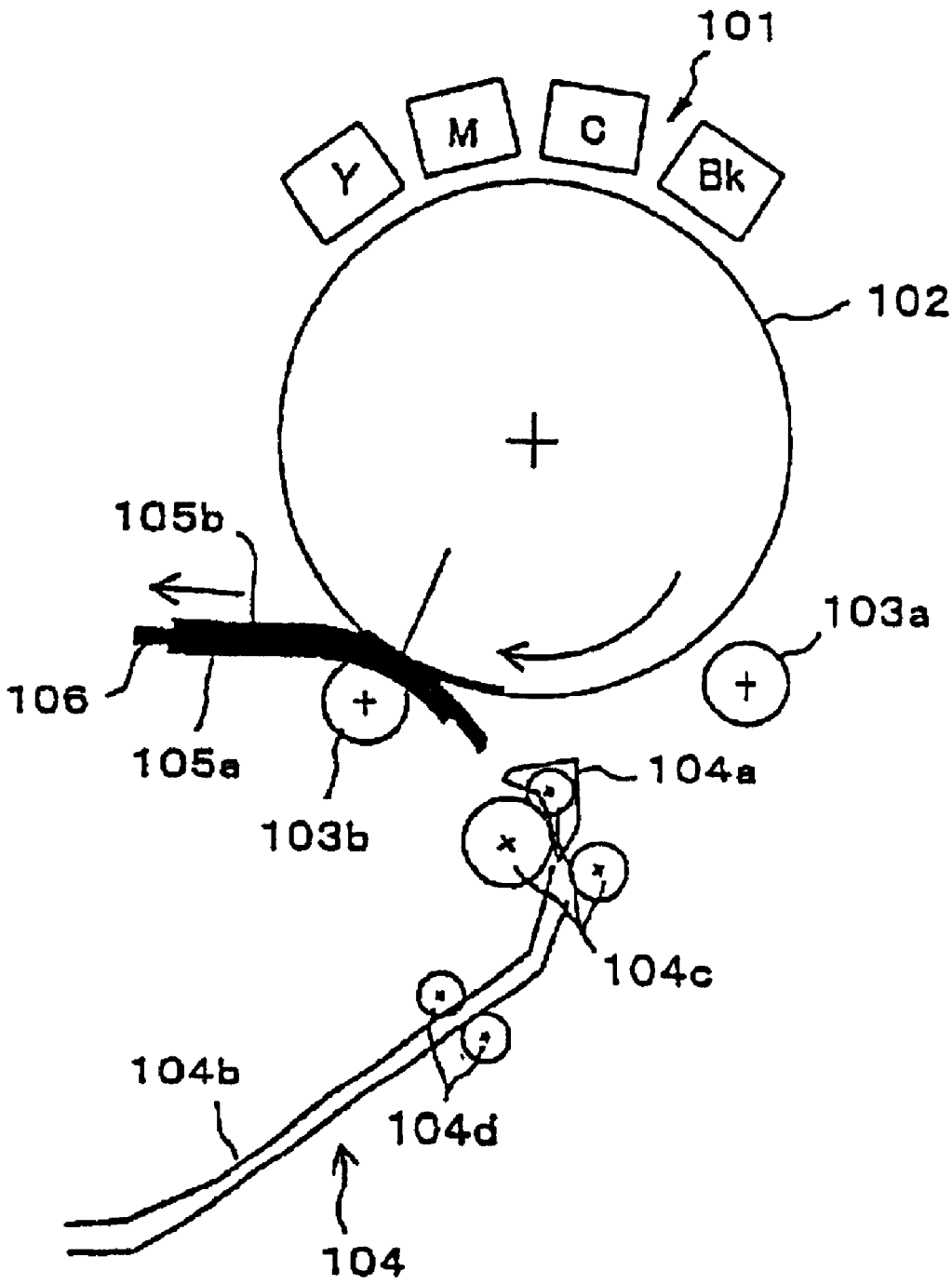
FIG. 4 is an explanatory diagram showing the concept of the present invention, in the state of a transfer paper in a second transfer unit.

Thereafter, the front and back sides of the paper 106 are inverted by the inverting section 104. During the operation, the image supporting member 102 continues the rotation. The paper 106 is inverted immediately by the inverting section 104 so as to be discharged with the back surface 106*b* oriented to the image supporting member 102 side (FIG. 3). The image 105*b* for the second surface is transferred on the back surface 106*b* of the paper 106 by the second transfer section 103*b* so as to complete dual sided printing (FIG. 4).

The inverting section 104 comprises a branched nail 104*a* driven by an unshown solenoid, an inverting conveyance path 104*b*, and conveyance rollers 104*c*, 104*d* rotated by an unshown motor. As shown in FIG. 1, in the case the paper 106 enters into the inverting conveyance path 104*b* from the first transfer section 103*a*, the branched nail 104*a* opens the first transfer section 103*a* side of the inlet of the inverting conveyance path 104*b*, and as shown in FIG. 3, in the case the paper 106 is sent out from the inverting conveyance path 104*b* to the second transfer section 103*b* side, it opens the second transfer section 103*b* side.

Although explanation is not given here, fixation is carried out after the transfer. The fixing operation is executed, for example twice, that is, after the transfer by the first transfer section 103*a* and after the transfer by the second transfer section 103*b*.

Accordingly, by providing the first and second transfer sections at two positions, unlike an ordinary dual sided printing mechanism (method), since the dual sided images can be formed by one cycle rotation of the image supporting member 102 from paper feeding to paper discharge, the time needed from starting paper feeding to completing dual sided printing can be extremely short.

1.2 Image Formation

As a method for producing an image on the image supporting member 102 by the image formation section 101, various methods as follows can be used.

(1) The melting type ink jet method using an intermediate transfer member for the image supporting member
(2) The ink jet method using a special intermediate transfer member for dealing with various kinds of papers
(3) The toner jet method for forming an image by jetting a charged toner as a coloring particle by the electric field function
(4) The magnetography method for forming an image by selectively adhering a toner onto an image supporting member by forming a thin layer of a magnetic toner as a coloring particle with the magnetic property on a magnetic roller, and generating an electric field between electrodes facing with each other with respect to the image supporting member
(5) The electrophotography method for producing an image by forming an electrostatic latent image on an image supporting member such as a photosensitive member, and developing the latent image by the function of the electric field by a charged toner as a coloring particle (the electrophotography method includes the dry electrophotography method of developing with a wet toner, and a wet electrophotography method of developing with a wet toner.)
(6) The ion flow method capable of forming an electric latent image on an image supporting member without using a photosensitive member, or the like.

Among these examples, An image formation device for forming an image by an electrophotography method is used widely for a copying machine or a printer in the offices, and it is extremely advantageous in terms of the high speed property, the economic property, or the like. Therefore, in this embodiment, a method for producing an image on an image supporting member by the electrophotography method will mainly be explained.

In the electrophotography method, an image is produced by forming an electrostatic latent image using a photosensitive member, and developing the same. In general, in the case of obtaining a color image by superimposing a plurality of images on an image supporting member, the image supporting member 102 may either be a photosensitive member or an intermediate transfer member. The method of obtaining an image by repeating the charging, exposing, and developing operations on the photosensitive member is called the IOI (image on image). It is characteristic of this method that an extra mechanism such as an intermediate transfer member, and a first transfer unit which transfers an image thereon, is not needed since a color image can be obtained on the photosensitive member. On the other hand, in order to superimpose four colors on the photosensitive member, the latent image producing step (charging, exposure) should be carried out for a next latent image on a toner existing on the photosensitive member, and thus there are many technological problems such as difficulty in obtaining the latent image contrast, disturbance of an image by electrically scattering a toner due to charging on the toner, or the like. At present, a method using an intermediate transfer member, of temporarily copying an image from the photosensitive member to the intermediate transfer member, and superimposing a plurality of images on the intermediate transfer member so as to obtain a color image, is commonly used. Either method can be selected in view of the cost, the toner to be used, or the like.

As the shape of the image supporting member, a drum-like shape and a belt-like shape can be presented. In the case of the drum-like shape, it is advantageous in terms of the color matching (registration) owing to improvement of the rotation accuracy without the risk of meandering by fixation of the rotation axis, or the like. In contrast, for example, in the case the image producing units are prepared for four colors, or the length for the first surface and the second surface of the image, and the inverting time is taken, the drum diameter is enlarged and the machine itself becomes bulky. Moreover, in the case the drum diameter is enlarged, the phenomenon of adherence of the paper on the drum with the separation difficulty at the time of the paper transfer occurs. On the other hand, in the case of the belt-like shape, even in the case the belt circumferential length is prolonged, since the layout freedom degree is high and the machine can be designed compactly so that the curvature of the paper transfer position can be selected freely by arrangement of the belt, the countermeasure for the paper separation can be provided easier than the case of the drum. However in the case of the drum-like shape, the image disturbance, or the like, by the meandering of the belt or the belt tension change is not negligible at the time of driving, and thus the countermeasure thereto can hardly be provided. Since both methods have the advantages and disadvantages, it is preferable to select either of them according to the purpose.

As to the image producing device arrangement, as mentioned above, by providing a plurality of developing sections with respect to the photosensitive member, a color image can be produced on the photosensitive member by the above-mentioned IOI method. Moreover, it is also possible to produce an image by providing a plurality of image producing sections to the intermediate transfer member. As the image producing section comprising the intermediate transfer member, a tandem type having a plurality (mainly four sets) of single color image producing units having a latent image formation and developing step, arranged with respect to a photosensitive member, is conceivable. The tandem type is of a method of obtaining a color image on the intermediate transfer member, by repeating a step of transferring (first transfer) an image produced on the photosensitive member by a plurality of times with a plurality of photosensitive members in contact with the intermediate transfer member. The advantage of the tandem type is a high productivity owing to the ability of continuously producing the color images.

In addition thereto, a color image can be obtained on the intermediate transfer member also by the so-called revolver developing type or developing arrangement type configuration, comprising a photosensitive member in contact with the intermediate transfer member for forming a latent image on the photosensitive member. According to the method, for example, in the case of forming a color image of Y, M, C, Bk colors, an electrostatic latent image is formed on the photosensitive member, and the Y image is developed by a Y developing unit. Then, the Y image is transferred from the photosensitive member to the intermediate transfer member. Thereafter, the M latent image is formed again on the photosensitive member at the point where the intermediate transfer member makes a round so that the photosensitive member and the Y image coincide so as to have the M image superimposed thereon. Then, the image is developed by the M developing unit and transferred from the photosensitive member to the intermediate transfer member at the Y image position. By repeating the step for the C and Bk images, a color image can be obtained on the intermediate transfer member. In this case, for obtaining the color image, the intermediate transfer member needs to turn around for four times.

In addition thereto, it can also be adopted in the so-called two station method configuration comprising two photosensitive members with respect to an intermediate transfer member, with two sets of developing units in each photosensitive member provided, for obtaining a four color image in two rounds by producing images of two colors on the intermediate transfer member while the intermediate transfer makes a round (claims 19, 20). In this case, the intermediate transfer member needs to make a round for two times in order to obtain a color image although it needs to make a round for four times in the revolver developing method. And furthermore, although the productivity is poorer than that of the tandem method, it may be produced compactly.

This method is most useful in the configurations wherein the intermediate transfer member needs to make a round for a plurality of times for obtaining a color image. For example, in obtaining a dual sided printed image by such a machine, in the case of the revolver developing type with an intermediate transfer member with respect to a photosensitive member, the intermediate transfer member needs to rotate by four times for printing the first surface, and further by four times for printing the back surface, totally eight times. However, according to the present invention of producing a dual sided printed image on the intermediate transfer member, the intermediate transfer member needs only to rotate by four times, and thus a dual sided printed first print can be obtained at a double rate.

1.3 Inversion

In the paper inverting mechanism after forming an image on the first surface 106*a* of the paper 106 by the first transfer section 103*a*, the switch back method for inverting the paper 106 by inserting the paper 106 from the paper tip end to the paper inverting conveyance path (also referred to as the stack) 104*b*, and taking out the paper 106 from the stack 104 from the paper 106 rear end after inserting the paper into the stack 104*b* to the rear end as shown in FIGS. 1 to 4, is often used. In addition thereto, a method of inverting the paper in the right and left direction by twisting in the paper conveyance path, or the like, can be presented. Examples of the method include a method of providing a tray in a shape twisted in the right and left direction, and passing the paper therethrough so as to be inverted, and a turn bar method in a continuous paper inverting mechanism for a roll paper. Since the switch back method can be used only for a cut paper, this method is effective for a roll paper, or the like.

1.4. Image Interval

Figure 5:
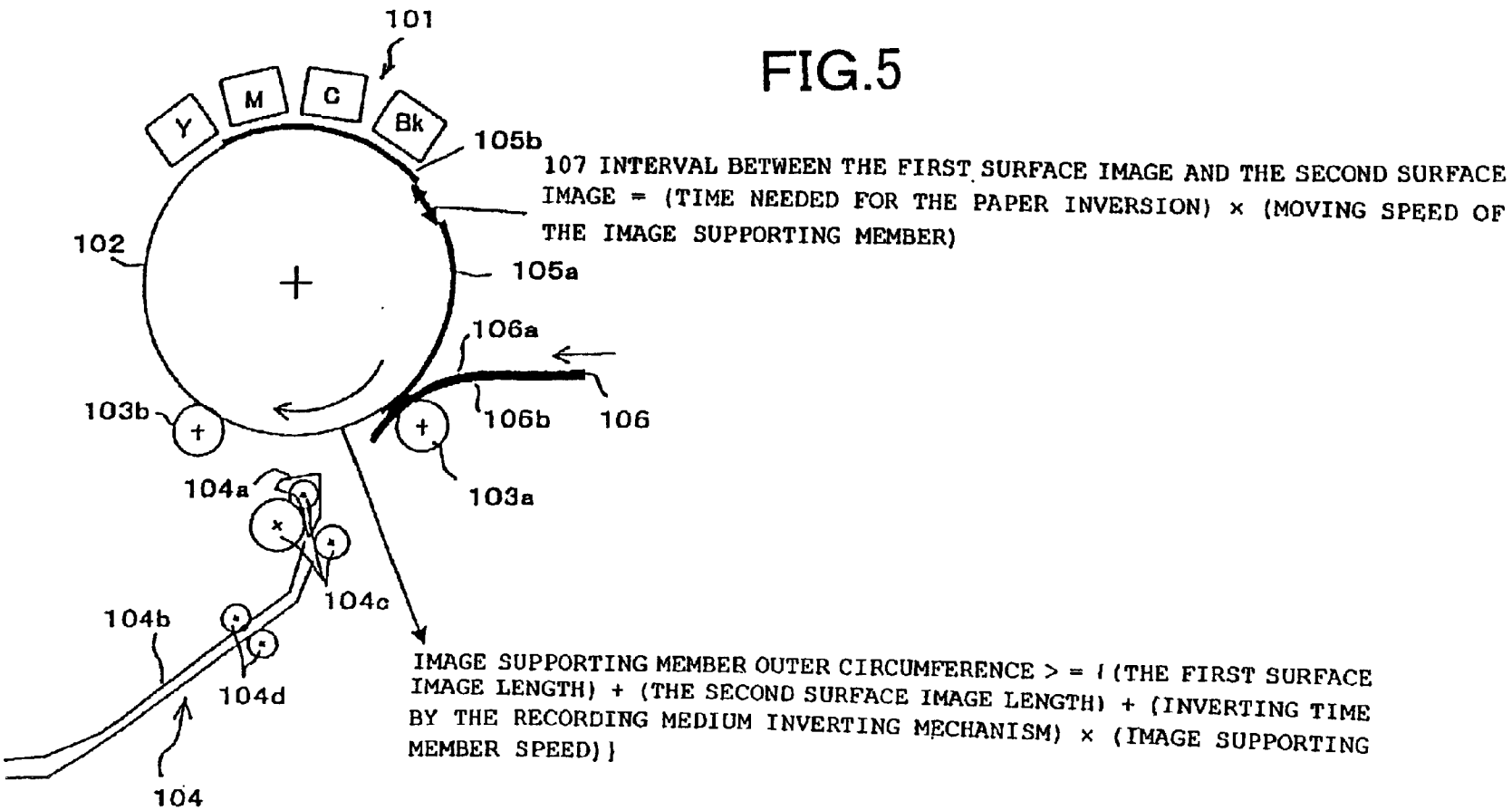
FIG. 5 is an explanatory diagram showing the relationship between the formed image interval and the image length, and the outer circumference length of an image supporting member.

For the paper inversion, time is needed to some extent. Since the images 105*a*, 105*b* on the image supporting member 102 proceed according to the rotation of the image supporting member 102 during the inversion of the paper 106, the top of the paper 106 back surface 106*b* inverted by the second transfer section 103*b* after transfer by the first transfer section 103*a*, and the top of the second surface image 105*b* on the image supporting member 102 should coincide. Therefor, the interval for the time needed for the paper inversion should be provided between the first surface image 105*a* and the second surface image 105*b*. Then, as shown in FIG. 5, the interval between the first surface image 105*a* and the second surface image 105*b* should be at least for the multiple of the "image supporting member speed" and the "time needed for the paper inversion".

Furthermore, in the case of an image formation method of forming a color image on the image supporting member 102 by superimposing an image for each color while rotating the image supporting member for a predetermined times as in the image producing method later described, such as the revolver developing method, the entire circumferential length of the image supporting member 102 should be a length of the total sum of the image lengths of the first surface image 105*a* and the second surface image 105*b* and the length needed for the subsequent inverting time. However, the definition of the image supporting member 102 length depends on the image producing method. For example, in the case of a single color device or a tandem type device, the image production is possible continuously regardless of the image supporting member position (without the need of waiting for the turn of the image supporting member), and thus the circumferential length is not limited to the above-mentioned value.

That is, the interval between the first surface image 105*a* and the second surface image 105*b* needs to be set by the (time needed for the inversion of the recording medium)×the (moving speed of the image supporting member) or more. The outer circumference of the image supporting member 102 is set to be a length of {(the first surface image length)+(the second surface image length)+(the inversion time by the inverting unit)×(the image supporting member speed)} or more in the case the first surface image 105*a* and the second surface image 105*b* are to be transferred onto the front and back sides of the paper 106, the first surface image

105*a* is transferred onto the first surface 106*a* of the paper 106 by the first transfer section 103*a*, and the second surface image 105*b* is transferred onto the second surface 106*b* of the paper 106 by the second transfer section 103*b*.

1.5 Transfer

As mentioned above, the first surface image 105*a* and the second surface image 105*b* formed on the image supporting member 102 are transferred onto the first surface 106*a* and the second surface 106*b* of the paper 106 by the first transfer section 103*a* and the second transfer section 103*b*, respectively. Since the second surface image 105*a* is produced on the image supporting member 102 by a predetermined interval at this step, that is, after transferring the first surface image 105*a* on the image supporting member 102 to the paper front surface 106*a* at the step of transfer by the first transfer section 103*a*, in the case the first surface is transferred by, for example, clamping the paper 106 between a transfer roller and the image supporting member 102, the second surface image 105*b* on the image supporting member 102 may be disturbed if the transfer roller is left in contact with the image supporting member 102. Therefore, disturbance of the second surface image 105*b* on the image supporting member 102 should be prevented at the transfer step by the first transfer section 103*a* (hereinafter also referred to as the first transfer step).

Specifically, in the case a transfer roller is used as the transfer device, by providing the bias polarity switchably such that the bias of the same polarity as that of the toner charge polarity is applied on the roller so as to prevent adherence of a toner onto the transfer roller while the second surface image 105*b* passes through the transfer roller, the toner can be pressed in the direction to the image supporting member so as to prevent disturbance of the toner.

As an another unit, it is also possible to prevent contact of the transfer device with the image supporting member 102 by providing the transfer device at the transfer step of the first transfer section 103*a* as a non-contact transfer device. As the non-contact type transfer device, a korotoron charger, a sukorotoron charger, a brush charger, a proximity roller charger, or the like, can be presented. Also in the case of these non-contact type chargers, by cutting off the application of the transfer bias or applying the bias of the polarity opposite to that at the time of an ordinary transfer during the passage of the second surface image 105*b* in the first transfer section 103*a*, disturbance of the second surface image 105*b* can further be prevented.

As a still another unit, a method of separating the contact type transfer device such as a roller and a brush away from the image supporting member 102 surface during the passage of the second surface image 105*b* on the image supporting member 102 after the first transfer step, can be presented. Also in the case of the separation method, by cutting off the application of the bias of the transfer device or applying the bias of the polarity opposite to that at the time of an ordinary transfer during the passage of the second surface image 105*b*, disturbance of the second surface image 105*b* can further be restrained.

1.6 Fixation 1.6.1 Fixation Method

The above-mentioned description is for preventing disturbance of the second surface image 105*b* on the image supporting member 102 after transferring the first surface image 105*a* on the paper 106. Furthermore, disturbance of the first surface image 105*a* transferred on the paper 106 after the image transfer of the first surface image 105*a* onto the paper front surface 106*a* should be prevented until the second surface image 105*b* is transferred onto the paper second surface 106*b* so as to be discharged to the outside of the machine. In the case the image is produced by the electrophotography method, the toner jet method, the ion flow method, or the like, the toner is not fixed on the paper as it is so that the toner can be disturbed by the physical friction. In particular, according to the method of the present invention, the paper should be inverted after the first step, and thus it is highly liable that the first surface image 105*a* is rubbed. Therefore, it is necessary to prevent disturbance of the transferred first surface image 105*a* before it enters into the inverting section 104.

In order to prevent disturbance of the transferred image, the fixation should be carried out skillfully. As a method therefor, (1) a method of blowing a solvent called a setting agent to the first surface image for fixation, (2) a method of preliminarily designing a toner reactive with a light, an electromagnetic wave, or the like, of a predetermined wavelength so as to be condensed and fixed to a paper, and directing a light of the wavelength after the first transfer step (as an example, the ultraviolet ray fixation, or the like, can be presented), (3) a pressuring fixation method of crushing a toner by a strong pressure so as to be fixed on a paper, or the like, are conceivable.

As the most commonly used, and standard fixation method in the present copying machines and printers, the heating fixation method can be presented. As a specific heating fixation method, a fixation method of providing a heat source, such as a halogen lamp, and an electric heater using a platinum or nichrome wire inside a fixation belt or a fixation roller, heating the roller or the belt from the inside, contacting the surface of the heated fixation roller or the belt with the image surface, and melting the toner, is commonly used. Furthermore, in a high speed machine, a flush lamp fixation method of disposing a halogen flash lamp facing the image surface on the paper, providing a large electric current to the halogen lamp instantaneously for generating a highly strong infrared ray, and absorbing the infrared ray in a toner so as to generate heat and be melted, is also used. In a further high speed and large size machine, a method of arranging a plurality of infrared lamps, passing a paper therethrough for directly heating the paper surface without contact, a method of passing a paper through an electric heating furnace for fixation by the radiation heat inside the furnace, or the like, can be used as well.

In addition thereto, in the case the inverting step and the step of transferring the second surface image 105*b* onto the paper back surface 106*b* by the second transfer section 103*b* (hereinafter also referred to as the second transfer step) are executed without providing the fixation step after the first transfer step, and the both surfaces can be fixed finally after finishing the dual sided transfer, the fixation step can be carried out at one time, and thus it is highly advantageous in terms of the cost. Therefor, it is necessary to execute to the second transfer step without disturbing the first surface image 105*a* on the paper 106. In order to prevent disturbance of the toner image, it is effective to apply the charge of the same polarity as that of the toner to the members with the possibility of contacting with the first surface image 105*a* until finishing the second transfer step so as to prevent attraction or friction of the toner with respect to the members.

Moreover, at the second transfer step, since the first surface image 105*a* transferred on the paper front surface 106*a* faced not to the image supporting member 102 side but to the transfer device side, by the contact type charger, the unfixed first surface image 105*a* may be peeled off from the paper 106. Therefore, it is preferable to transfer the second surface image 105*b* to the paper back surface 106*b* without contact at the second transfer step.

Moreover, various types of the transfer simultaneous fixation method of heating the transfer roller to the paper itself for executing fixation simultaneously at the time of transferring the toner image from the image supporting member 102 to the paper 106 are proposed as well. According to the method, disturbance of the toner image transferred on the paper 106 cannot be rubbed and disturbed after the transfer. Therefore, it is effective to use the transfer simultaneous fixation method at either of or both of the first transfer step and the second transfer step in terms of the image disturbance prevention after the first transfer step.

1.6.2 Twice Fixation

By providing the fixation step after the first transfer step, the fixation step can be provided twice on the whole together with the fixation after the second transfer step. Hereinafter, the fixation step executed after the first transfer step is referred to as the first fixation step, and the fixation step executed after the second transfer step is referred to as the second fixation step.

As to the purpose of the fixation step, it is the minimum necessary condition not to have the image disturbance at the time the use handles the printed paper. However, the purpose of the first fixation step is slightly different. That is, it is to prevent disturbance of the first surface image 105*a* transferred on the paper 106 after the first transfer step until finishing the second transfer step, and thus the degree of demand is lower compared with the fixation property required at the time the use handles the printed matter. For example, if a user writes on a surface of a booklet of dual sided printing with a ball point pen, or the like, the toner image printed on the back surface at the written part is sometimes transferred onto the next page. This can be the criterion of the poor fixation property, and thus the fixation by the machine should be carried out sufficiently so as not to cause such a problem. However, since the demand to the first fixation step is to the extent that the image surface is not disturbed at the subsequent paper inverting step and the second transfer step, certain fixation with a high fixation temperature is not required.

In general, by passing through the fixer twice for dual sided printing, the water content of the paper is reduced by the first fixation so that the electric resistance of the paper is raised. As a result, at the time of transferring the back surface, a sufficient transfer electric field can not be obtained so that the phenomenon of lowering the transfer ratio and deteriorating the image is observed. Therefore, by providing the quantity of heat applied to the paper 106 at the first fixation step smaller than the quantity of heat applied to the paper 106 at the second fixation step, the second surface image 105*b* can be transferred to the paper back surface 106*b* without causing the image deterioration or the transfer ratio decline.

In principal, in the case execution dual sided printing is scheduled preliminarily, a method of executing the temporary fixation at a low temperature for the first fixation, and executing the main fixation for the second fixation as mentioned above, is conceivable. However, since the fixation temperature of the fixer cannot be switched drastically, it is difficult to adopt the above-mentioned fixation method in the ordinary dual sided printing. However, since the two fixers are provided in the present invention, by setting them at a predetermined fixation temperature, the quantity of heat applied to the paper 106 can be varied at the first fixation step and the second fixation step. That is, by setting the fixer temperature at the first fixation step lower than the fixer temperature at the second fixation step, the quantity of heat applied to the paper can be varied at the first fixation step and the second fixation step.

If is preferable to provide the quantity of heat at the first fixation step as little as possible to the extent that the image is not disturbed at the inverting step. However, on the contrary, if the fixing temperature of the fixer at the first fixation step is too low, the phenomenon called cold offset, of adherence of the paper image onto the surface of the fixing roller or the fixing belt, and peel off, is generated. Although the temperature at which the phenomenon occurs differs depending on the fixer configuration and the kind of the toner, since generation of the cold offset results in the remarkable disturbance of the image, it should be avoided. Therefore, the temperature of the fixer at the first fixation step is set to be in a range not to cause the cold offset, and the lowest temperature at which the cold offset is not generated is set to be the lower limit.

Moreover, in the case the fixation temperature of the fixer is same, the quantity of heat applied to the paper 106 can be adjusted by the time of having the paper 106 in contact with the surface of the fixing member, such as the fixation roller or belt. For example, in the case the fixer is provided commonly as the fixer at the first fixation step and the fixer at the second fixation step for cost reduction, for changing the quantity of heat provided to the paper at the first fixation step and the second fixation step, the time for contacting the paper 106 with the fixing member can be varied such that the contact time at the first fixation step is shorter. As an example of changing the time for contacting the fixing member and the paper 106, by reducing the contact nip of the fixation roller with respect to the paper 106 at the second transfer step at the time of dual sided printing, the quantity of heat provided to the paper can be adjusted so as to avoid wasteful application of the quantity of heat to the paper to the paper. Thereby, energy saving can be achieved particularly in the case of dual sided printing.

In executing dual sided printing in the present invention, in the case the fixation step is executed separately at the first fixation step and the second fixation step, since a slight amount of quantity of heat is applied on the paper 106 to the extent not to disturb the image, the quantity of heat to be applied to the paper 106 at the second fixation step can be smaller than that of the case of an ordinary one side printing. This is because the energy needed for raising the paper 106 temperature at the second fixation step can be restrained since the paper 106 temperature is raised already at the first fixation step. Therefore, in the case dual sided printing is executed frequently than an ordinary image formation device, the quantity of heat to be applied to the paper 106 at the second fixation step may be reduced. According to the configuration, an image formation device capable of further saving the energy can be provided.

Moreover, as a problem in an ordinary dual sided printing, the gloss difference of the images 105*a*, 105*b* on the paper front surface 106*a* and the paper back surface 106*b* can be presented. That is, since the image 105*a* on the paper front surface 106*a* side passes through the fixer twice, the toner can be melted easily so as to provide glossiness compared with the image 105*b* on the back surface side. However, according to the present invention, since the quantity of heat to be applied to the paper 106 at the time of fixing the image 105*a* onto the paper front surface 106*a* can be restrained, unlike the ordinary dual sided printing, an extreme glossiness difference between the front and back surfaces can hardly be generated.

1.6.3 Surf Fixation

Figure 6:
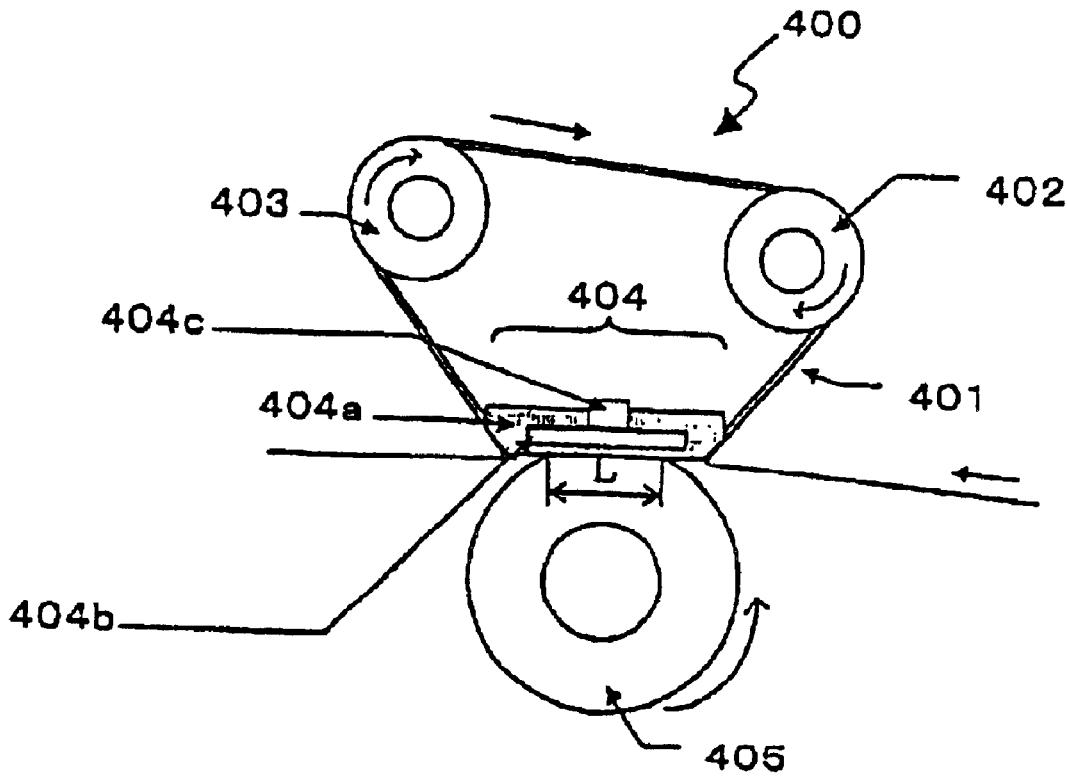
FIG. 6 is a diagram showing an embodiment of a fixing device used in this embodiment.

A surf fixation device 400 as shown in FIG. 6 can be used for the fixer. As it is observed from FIG. 6, the surf fixing device is for fixing by rotation a fixing film 401. It will be described below in detail. The fixing film 401 comprising an endless belt-like heat resistant film, is laid around a driving roller 401 as the supporting rotating member for the film, a driven roller 402, and a heating member 404 disposed below the rollers 402, 403 so as to be rotated by the driving force of an unshown motor for driving the driving roller 402. The heating member 404 comprises a heater supporting member 404*a* comprising a substrate with the side facing a pressuring roller 405 described later as a flat surface, a fixing heater 404*b* disposed on the surface of the heater supporting member 404*a* on the side in contact with the fixing film 401, and a fixation temperature sensor 404*c* provided to the heating member 404.

The driven roller 403 serves also as a tension roller for the fixing film 401. The fixing film 401 is rotated in the clockwise direction by the drive of the driving roller 402 in the clockwise direction in the figure. The rotation drive speed is adjusted such that the speed of the transfer material (paper 106) and that of the fixing film 401 can be equivalent in a fixation nip area L wherein the fixing film 401 comes in contact with the pressuring roller 405 in contact with the flat surface part of the heating member 404 with a predetermined pressure. Here, the pressuring roller 405 is a roller having an elastic layer with a good mold releasing property, such as a silicone rubber, and it is pressed against the fixation nip area L by a total 4 to 10 kg contact pressure while rotating in the counterclockwise direction.

Moreover, as the fixing film 401, those having the excellent heat resistance, mold releasing property, and durability, are preferable, and thin one of a total thickness of 100 $\mu$m, preferably 40 $\mu$m is used. For example, a single layer film, pt a composite layer film of a heat resistant resin, such as a polyimide, a polyether imide, a PES (polyether sulfide), a PFA (perfluoro alkyl tetrafluoride vinyl ether copolymer resin), or the like, such as a 20 $\mu$m thickness film with at least the image contact surface side provided with a mold releasing coating layer of a fluorine resin such as a PTFE (ethylene tetrafluorde resin), and a PFA having a conductive material added, applied by a 10 $\mu$m thickness, or an elastic layer of a fluorine rubber, and a silicone rubber, or the like, can be used.

The heating member 404, as mentioned above, comprises the heater supporting member 404*a* comprising a flat surface substrate, and the fixing member 404*b*. The heater supporting member 404*a* is produced by forming a material having a high temperature conductivity and a high electric resistance ratio, such as an alumina into a flat plate-like shape, with the fixing heater 404*b* made of a resistance heat generating member disposed on the surface in contact with the fixing film 401 in the longitudinal direction. The fixing heater 404*b* is produced by, for example, coating an electric resistance material such as an AG/PD, and a $Ta_2N$, in a line-like or band-like shape by screen printing, or the like. Moreover, an unshown electrode is formed on both end parts of the fixing heater 404*b*. By energizing between the electrodes, the resistance heat generating member generates heat. Furthermore, the fixing temperature sensor 404*c* comprising a thermistor is provided on the surface of the heater supporting member 404*a*, opposite to the surface provided with the fixing heater 404*b*.

According to the serve fixing device 400 with the configuration, the temperature information of the substrate (heater supporting member 404*a*) sensed by the fixing temperature sensor 404*c* is sent to an unshown controlling unit. By the controlling unit, the electric power amount to be supplied to the fixing heater 404*b* is controlled so that the heating member 404 is controlled at a predetermined temperature.

Conventionally, such a surf fixing mechanism has not been used in a high speed machine. The reason is that although the surf fixing mechanism has an advantage of a high speed rise since it has a thin film fixing film as the fixing member with a small heat capacity, due to the small heat capacity, the temperature is taken away by the paper quickly in a high speed machine so as to have the temperature decline, and it leads to the temperature irregularity in the fixing film. However, in the case the two fixers are provided as in the present invention, since the fixing temperature can be set at a low level at the first fixation step as mentioned above, the surf fixation technique can be adopted also in a high speed machine.

1.7 Registration

IN general, the fed paper 106 is positioned for transferring the images 105*a*, 105*b* on the image supporting member 102 to a predetermined position of the paper 106 at the time of transfer (it is called registration or resist). The resist includes the positioning in the paper conveyance direction called the tip end resist, and the positioning in the direction orthogonal to the paper conveyance direction called the lateral resist. In order to carry out the tip end resist, the paper 106 feeding operation is stopped temporarily by a roller called a resist roller (later described), and the roller feeds out the paper to the transfer step at a predetermined timing from a signal from the sensor. According to the present invention, since the transfer step is provided at two positions of the first transfer sections 103*a*, 103*b*, it is preferable to execute the tip end resist positioning immediately before the second transfer step in addition to the ordinary paper 106 supplying part from the paper feeding band for enabling the transfer with the image position on the back side accurately positioned so as to achieve a highly accurate positioning. The paper tip end resist step for the second transfer step is preferably disposed in the vicinity of the second transfer section 103*b* as much as possible, however, in the case it is difficult to dispose the same in the vicinity due to the spatial limitation, the paper feeding out roller (corresponding to the conveyance roller 104*c*) of the paper inverting section 104 can serve also for the function. If a sufficient resist accuracy can be obtained, this configuration is rather preferable for achieving a low cost and saving the space.

Figure 12:
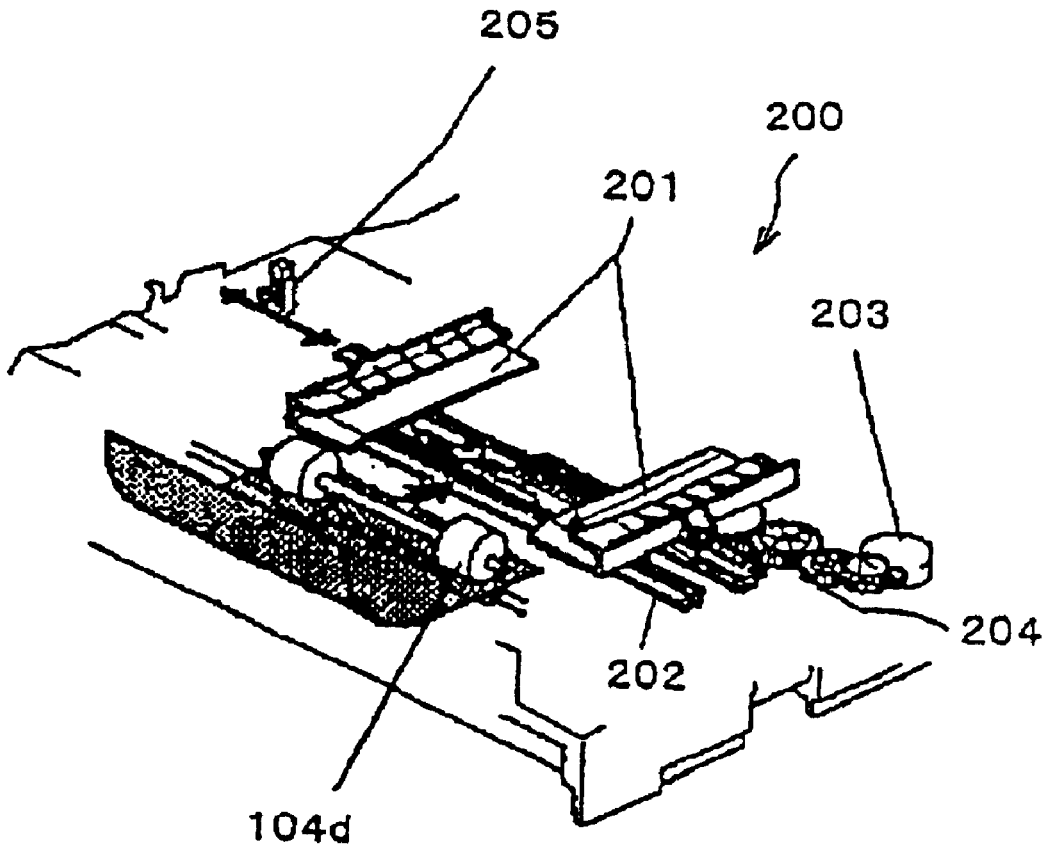
FIG. 12 is a perspective view of a jogger as a lateral resist adjusting mechanism of the color image formation device shown in FIG. 11.

Similar to the tip end resist, the lateral direction resist (lateral resist) is also necessary for a highly accurate printing. Also in the case of an ordinary dual sided printing, after finishing the transfer and the fixation of the front surface, and via the paper inverting section 104, the second transfer and fixation are executed. At the time, in some cases, positioning of the paper in the lateral direction is executed at the paper inverting section 104 or another section. It is carried out for preventing the print of the second surface image 105*b* at a position with a perpendicularity different from that of the first surface image 105*a* at the time of the back surface image 105*b* transfer if the paper has skewing in the conveyance path after fixation. Similarly in the present invention, a highly accurate dual sided printing can be enabled by carrying out the lateral direction positioning of the paper 106 between the first transfer step and the second transfer step. The lateral direction positioning can be executed by using a lateral positioning mechanism called a jogger in the paper inverting section 104 without the need of providing a space particularly for the step. The jogger will be described later with reference to FIG. 12.

1.8 Paper Path

The present invention aims mainly at achieving high speed dual sided printing, but in the actual practice by a user, not only dual sided printing but one side printing may be called for. Also in this case, the productivity same as that of the conventional products would be provided. What can be problematic at the time of one side printing in a machine with the present invention adopted is that loss of the time by carrying out the transfer step, and in some cases also the fixation step each by two times, and that in the conveyance path by unnecessary entrance into the paper inverting section. Then, by having the paper 106 pass through either of the first transfer section 103*a* and the second transfer section 103*b* at the time of one side printing for the image transfer, the speed same as that of the ordinary machine in one side printing. In this case, it is preferable to have a paper passage path for switching so as to have the paper 106 pass through only the second transfer section 103*b* (described later) because, as mentioned above, in some cases, the first fixation step has only the fixing power for the temporary fixation. However, depending on the type of the machine, it is preferable to have the paper pass through the first transfer section 103*a*, and further the paper inverting section 104.

In the case of use as a printer or a copying machine, for one side printing for a single piece, the face up paper discharge of discharging the paper with the printed surface facing the user operating the machine, is preferable because the copy or printing result can be confirmed by the user without the need of taking out the paper. However, in the case of copying or printing out a plurality of papers, in terms of arrangement of the pages, the face down paper discharge with the image surface down, is preferable because in the case a plurality of pages are outputted from the top page by the face up paper discharge, the papers are arranged in the inverted order on the paper discharge stack. In consideration of this point, some of the copying machines and printers have a mechanism at the paper discharge side for judging whether the face up paper discharge is preferable or the face down paper discharge is preferable, and discharging the paper after inversion each time as needed.

In the present invention, since the chance of output of a plurality of pages is high in the case of executing dual sided printing, the machine configuration is provided such that the face down paper discharge is executed basically in this case. And in the case of outputting a one side cut paper, the paper 106 discharge direction can be selected freely by for example, selecting the transfer step position and whether or not the paper passes through the paper inverting section 104 such that, (1) the face up paper discharge is carried out in the case the paper is fed to the second transfer section 103*b*, printed and discharged after skipping the first transfer section 103*a*, and (2) the face down paper discharge is carried out in the case the paper is inverted by the paper inverting section 104 after transfer by the first transfer section 103*a*, and discharged after passing through the second transfer section 103*b* without a transfer operation, or after skipping the second transfer section 103*b*. According to the configuration, the paper inverting section conventionally mounted separately at the paper discharge position can be eliminated.

1.9 Speed at the Time of the Paper Inversion

Figure 15:
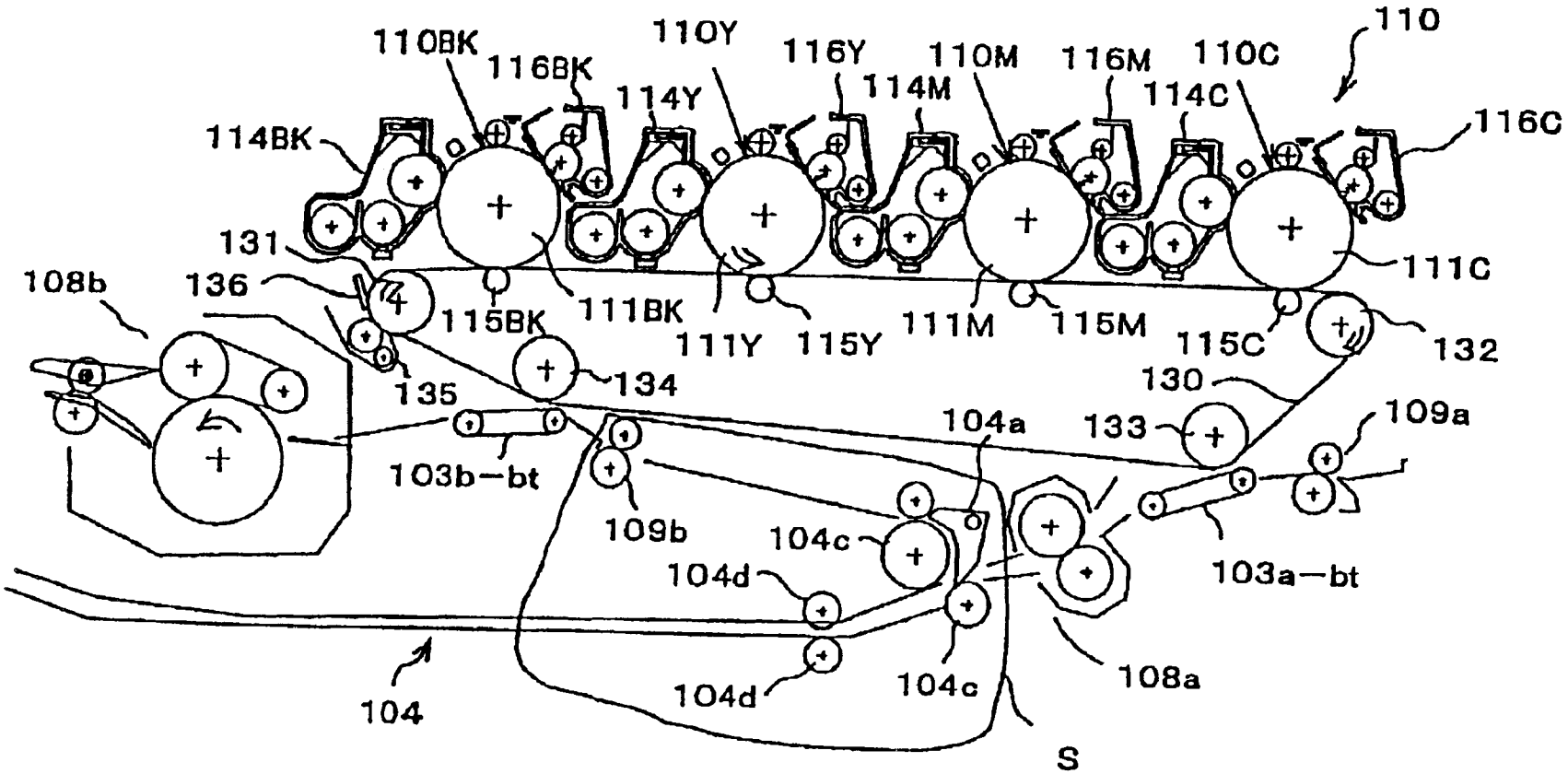
FIG. 15 is a schematic configuration diagram showing an embodiment with the transfer belt method adopted in a transfer unit of the tandem type color image formation device shown in FIG. 11.

In order to further improve the productivity in dual sided printing, it is apparent that the productivity can be improved by reducing the interval between the production of the first surface image 105*a* and the production of the second surface image 105*b* on the image supporting member 102 in consideration of the paper inversion time as mentioned above. That is, the moving speed of the paper 106 after passing through the first transfer section 103*b* needs not be same as the moving speed of the image supporting member 102. Therefore, in order to reduce the time necessary for the paper inversion, by having the moving speed of the paper 106 at the time of entering the paper 106 into the paper inverting section 104 so as to be inverted, and being sent to the second transfer section 103*b* higher than the moving speed (circumferential speed) of the image supporting member 102 after passing through the first fixation step, more preferably after passing through the first transfer section 103*a*, the time necessary for the paper 106 inversion can be reduced so as to further improve the productivity. In the examples described later, the conveyance path with the moving speed of the paper 106 raised is shown in FIG. 15 by the mark S.

1.10 Reading Speed

Moreover, in order to improve the productivity of the machine as a whole, the scanner reading speed is also an important issue in the case of a copying machine. Unlike the case of producing an image for each one surface in an ordinary machine, since the first surface image 105*a*, and the second surface image 105*b* are formed continuously on the image supporting member 102, unless the scanner image information reading speed for the first surface (front surface) and the second surface (back surface) of the manuscript is sufficiently high so as to correspond to the writing time thereof, the productivity is lowered. Therefore, including the time needed for the paper inversion, the total time for reading the first surface image and the second surface image of the manuscript by the scanner should be equal or shorter than the time needed for exposing the first surface image 105*a*, and the second surface image 105*b* onto the photosensitive member.

1.11 Interleaf

Furthermore, in the case the paper inversion takes time due to the machine configuration (in the case the time needed for having the paper passing through the paper inverting mechanism until it enters into the second transfer step is extremely longer than the time needed for having the image supporting member rotate after finishing the first transfer until the second transfer step), the interleaf method can be used for improving the productivity. Unlike the ordinary dual sided printing as shown in FIGS. 7 to 10 of producing an image for the first surface of the first paper (hereinafter, the number before the hyphen represents the number of the paper, and the number after the hyphen represents the number of the surface as 1-1), the second surface of the first paper (1-2), the first surface of the second paper (2-1), and the second surface of the second paper (2-2), wherein a large interval is needed between (1-1) and (1-2), the interleaf is a method of producing an image in the order of (1-1), (2-1), (1-2), (2-2) alternately so as to have the next paper fed while executing the paper inversion for having the first surface of the second paper transferred earlier.

The above-mentioned example corresponds to the space for the (one sheet paper length)/(image supporting member rotation speed). In the case a further longer inversion time is needed, by having the interleaf for three sheets, a space for one paper sheet can further be provided. In order to carry out the interleaf in copying, the copying machine should be a digital copying machine as well as it needs to accumulate the image information for at least (1-2) somewhere in the case of reading out (2-1) and (2-2) after reading out (1-1) and (1-2). Therefore, in the case of consecutively reading both surfaces of each page by the reading device by the interleaf method, the accumulation function for at least one screen is necessary. However, the case of reading the manuscript not by the consecutive reading of each page but in the order of interleaf during the interleaf operation is exceptional.

Figure 7:
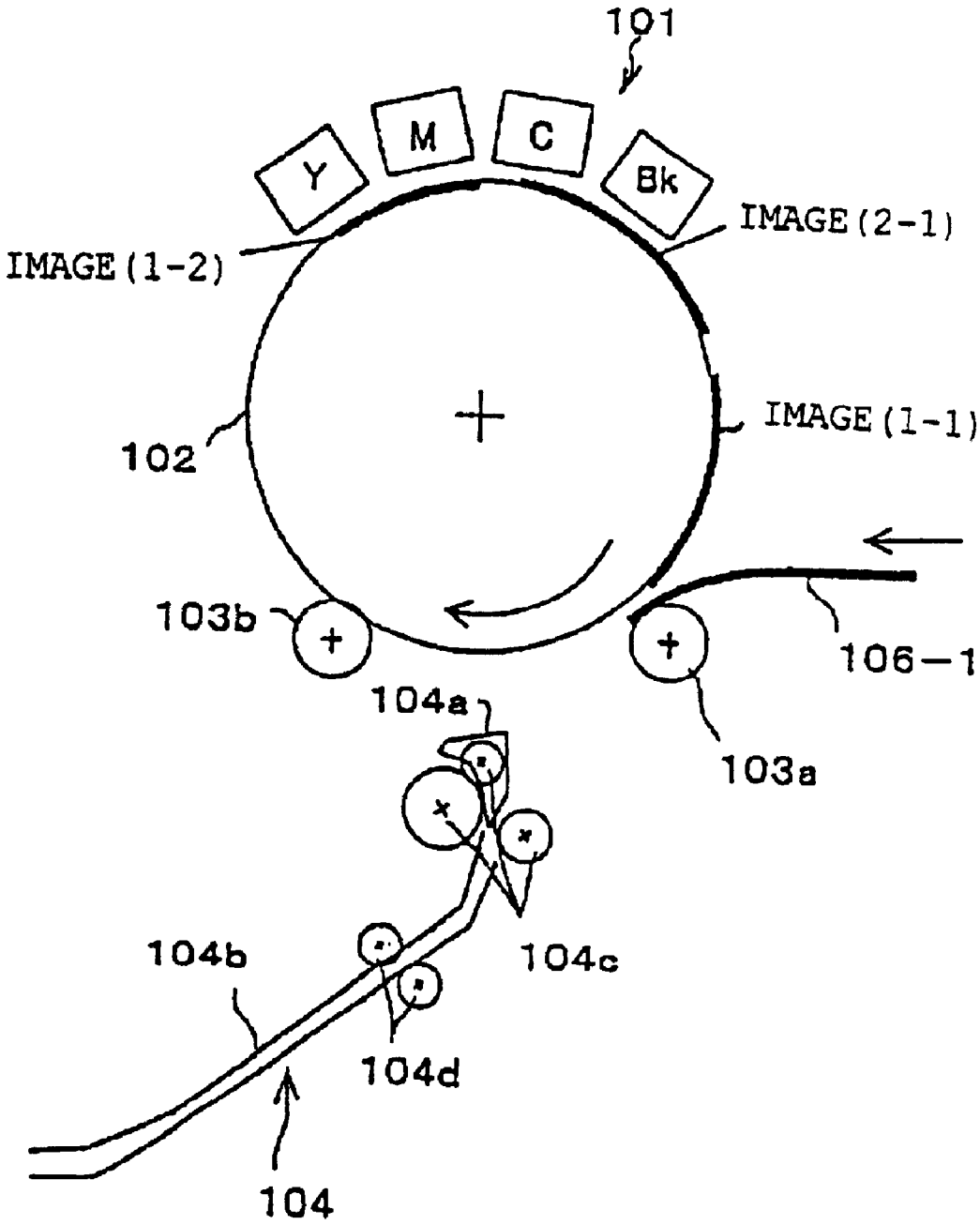
FIG. 7 is an explanatory diagram showing the operation of an interleaf adopted in this embodiment, in the state at the time of transferring an image onto a first surface of a first paper.

That is, in the interleaf operation, the images are supported by the image supporting member 102 in the order of (1-1), (2-1), (1-2), (2-2), (3-1), (4-1) . . . . Thereby, as shown in FIG. 7, the first paper 106-1 is fed into the first transfer section 103*a* facing to the image supporting member 102 so as to have the paper front surface 106*a* and the image (1-1) coincided. Then, the image (1-1) is transferred onto the paper front surface 106*a* of the first paper 106-1, and the paper is introduced into the paper inverting section 104 as shown in FIG. 8.

Figure 8:
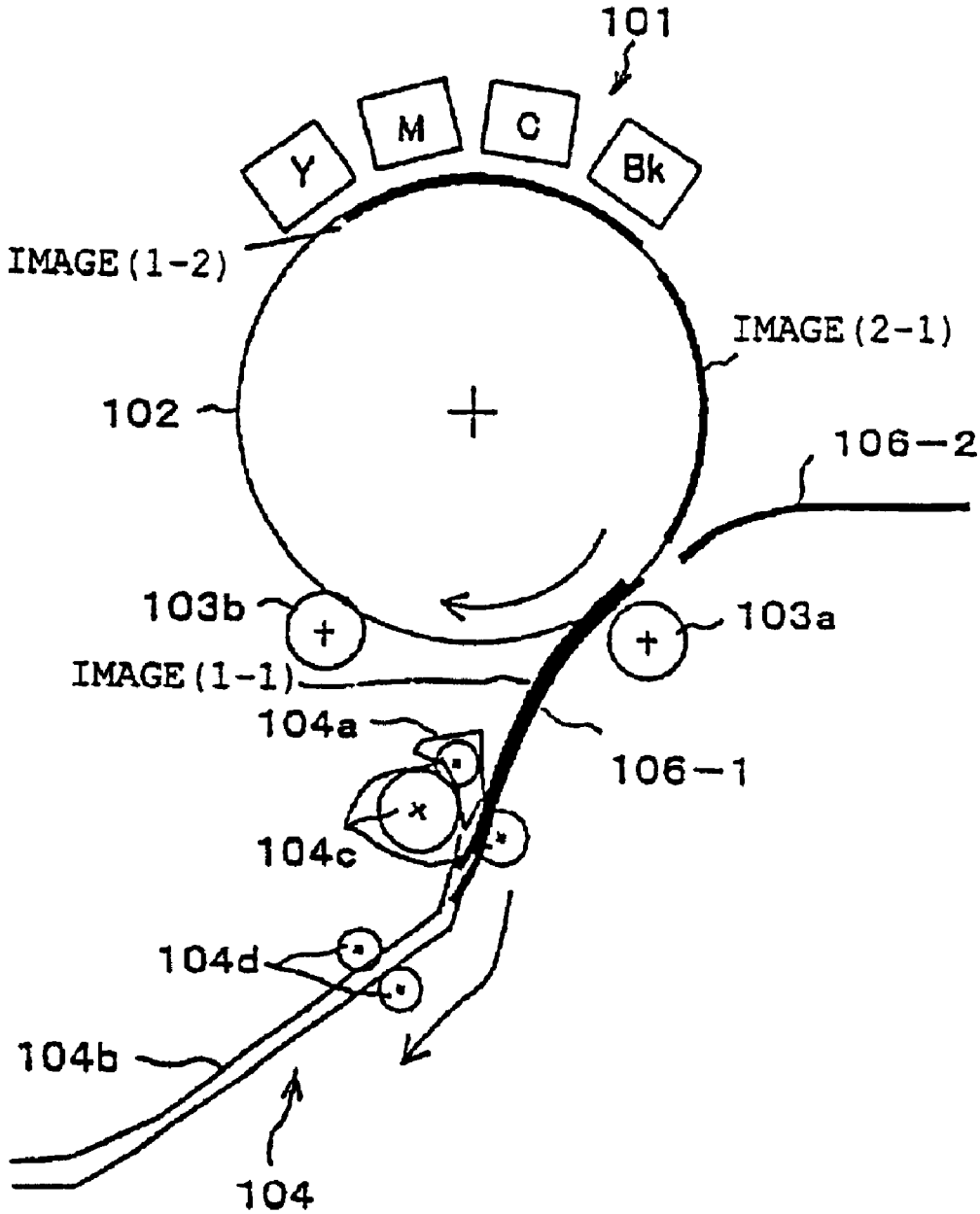
FIG. 8 is an explanatory diagram showing the operation of an interleaf adopted in this embodiment, in the state at the time of transferring an image onto a first surface of a second paper.
Figure 9:
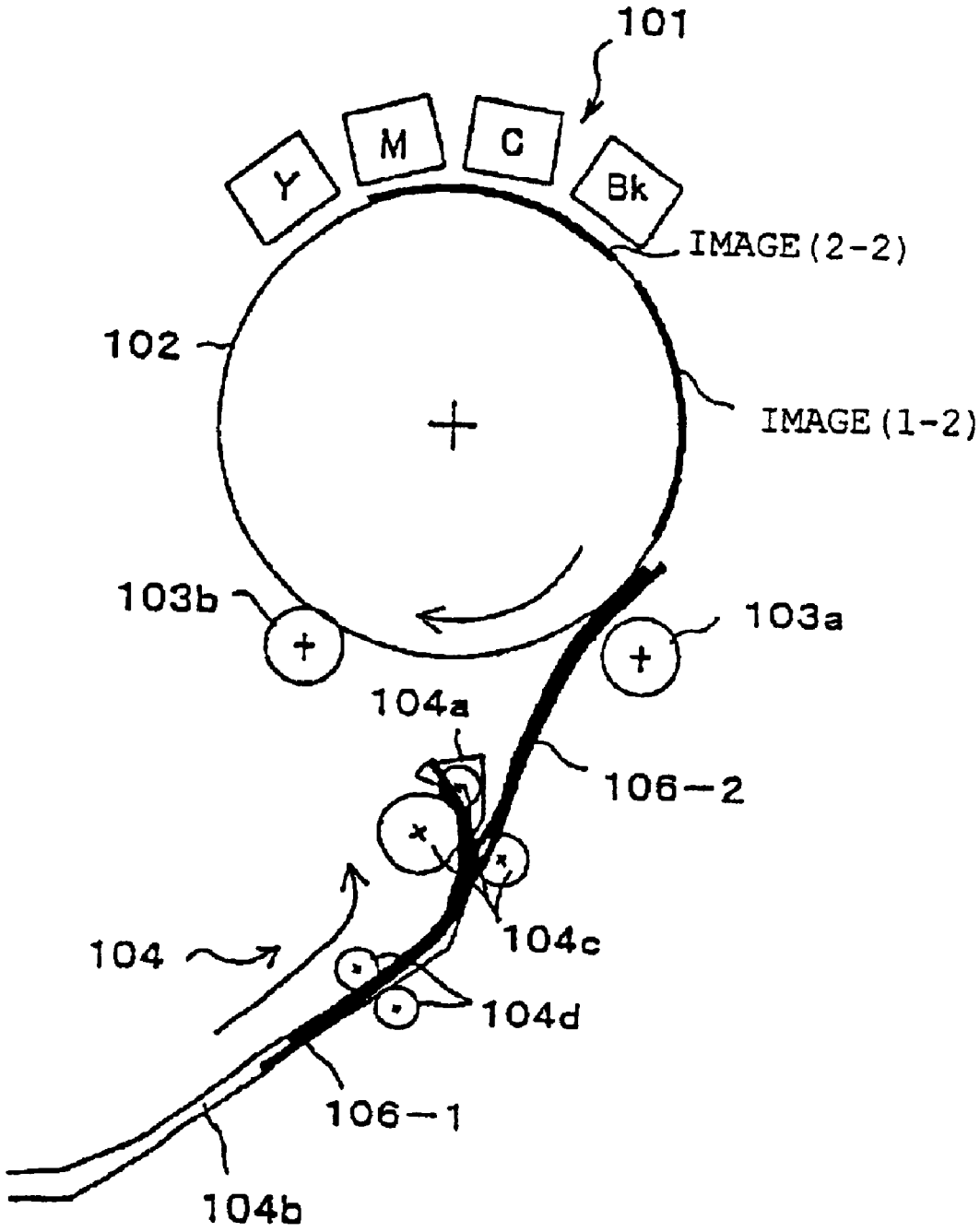
FIG. 9 is an explanatory diagram showing the operation of an interleaf adopted in this embodiment, in the state with the first paper with the image transferred on the first surface, and the second paper with the image transferred on the first surface passing by with each other in an inverting path.

Next, as shown in FIG. 8, the second paper 106-2 is fed into the first transfer section 103*a* with the front surface 106*a* facing the image supporting member 102 side corresponding to the image (2-1). After having the paper front surface 106*a* and the image (2-1) coincided, as shown in FIG. 9, the image (2-1) is transferred onto the paper front surface 106*a* of the second paper 106-2, and the paper is introduced into the paper inverting section 104. The first paper 106-1 has the rear end section clamped by the nip of the feeding out roller 104*c* so as to be fed out to the second transfer section 103*b* side before entrance of the second paper into the paper inverting section 104 so that they pass by at the inlet section of the inverting path 104*b* of the paper inverting section 104.

Figure 10:
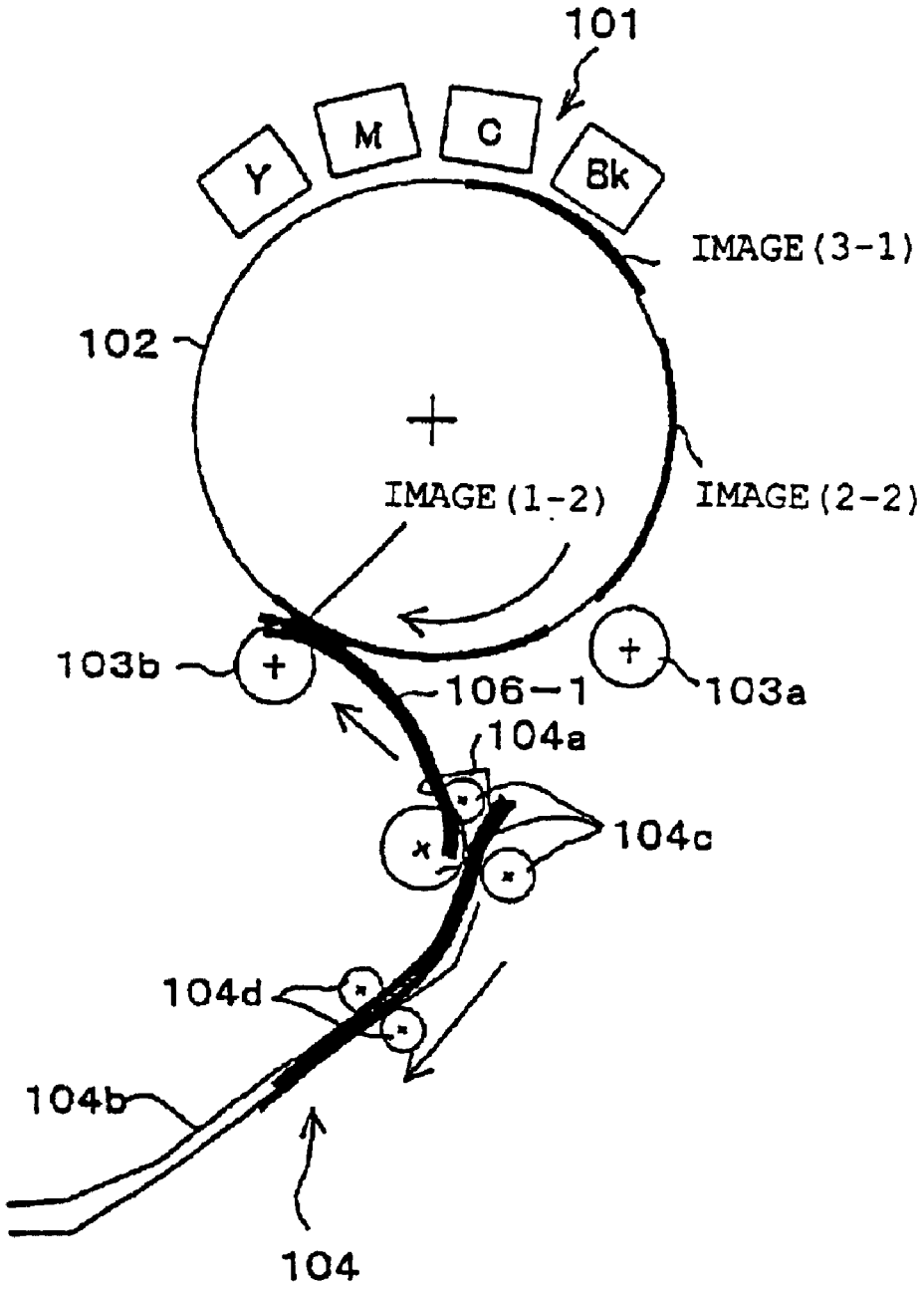
FIG. 10 is an explanatory diagram showing the operation of an interleaf adopted in this embodiment, in the state of transferring an image on a second surface of the first paper after having the first paper with the image transferred on the first surface, and the second paper with the image transferred on the first surface passing by with each other in the inverting path.

As shown in FIG. 10, the first paper 106-1 has the paper back surface 106 facing the image (1-2) corresponding to the back surface of the first paper at the second transfer section 103*b* so as to be sent out from the feeding out roller 104*c* at the same timing as that of the image (1-2), and the image (1-2) is transferred onto the paper rear surface 106*b* by the second transfer section 103*b*. While the operation, the second paper 106-2 enters into the further deeper side in the paper inverting path 104*b*. Next, the unshown third paper is conveyed by the same timing as that of the third front surface image (3-1). From the state similar to that of FIG. 9, with the second paper 106-2 to be fed out from the feeding out roller 104*c*, the third paper 106-3 with the image (3-1) transferred on the front surface 106*a* enters into the paper inverting section 104*c*. From this state, the image (2-2) is transferred on the back surface 106*b* of the second paper 106-2 by the second transfer section 103*b*. This image formation step is repeated.

As mentioned above, by executing the interleaf operation, the image can be formed efficiently in the order of the front surface 106*a* of the first paper 106-1, the front surface 106*a* of the second paper 106-2, the back surface 106*b* of the first paper 106-1, the back surface 106*b* of the second paper, the front surface 106*a* of the third paper 106-3, the front surface 106*a* of the fourth paper 106-4, the back surface 106*b* of the third paper 106-3 . . . . This is an example of the interleaf number of two sheets. In the case of the interleaf number of three sheets, the image formation is carried out continuously on the front surface of three paper front surfaces, and the image formation is continued by the same operation.

In the case of executing the interleaf operation, the relationship of the conveyance speed of the paper inverting section 104*c* at the time of inversion, the circumferential speed of the image supporting member 102, and the feeding out timing form the feeding out roller 104*c* should be set strictly. Moreover, it is needless to say that a resist roller can be used at the time of sending out the paper 106 to the second transfer section 103*b*.

1.12 Coping with the Jamming Process

A machine to have the present invention adopted is a machine with the requirement for a high reliability for the high speed operation. Therefore, paper jamming, which remarkably deteriorates the machine productivity should be avoided. The position at which the risk of the jamming is high is the point of separating the paper 106 from the image supporting member 102, or the like. Particularly in this machine, since the first and second transfer sections 103*a*, 103*b* are provided at two positions, the separation angle of the image supporting member 102 can hardly be provided in this configuration. That is, since the separation can be facilitated with a small radius of curvature on the image supporting member side at the paper transfer position, in order to improve the paper separation reliability, it is effective to have the transfer belt method as the paper transfer method so as to carry out the transfer with the paper attached on the transfer belt electrostatically as much as possible for facilitating the paper separation. The transfer belt method will be described later in the example with reference to FIG. 16.

1.13 Cooling of the Image Supporting Member

Moreover, in the machine configuration of the present invention, by providing the first fixation step after the first transfer step, the paper 106 and the image supporting member 102 comes in contact at the second transfer step so as to have the image supporting member 102 heated immediately after having the paper 106 heated at the fixation step. In the case the temperature of the image supporting member 102 is raised gradually, if the image supporting member 102 is a photosensitive member, the charging ability is lowered, and further, toner filming can be generated easily. Even in the case the image supporting member 102 is an intermediate transfer member, the intermediate transfer member can easily generate filming, the electric characteristics can be changed, or the photosensitive member is heated via the intermediate transfer member so as to generate filming of the photosensitive member, or the charging ability is lowered, and thus heat accumulation in the image supporting member 102 should be avoided. In order to avoid this, it is effective to provide a mechanism for cooling the image supporting member 102. As a cooling method, a method of providing a fan for cooling by air, a method of cooling by contacting a heat exchanger such as a heat pipe with the image supporting member for depriving the heat, or the like, can be presented. The cooling structure for the image supporting member will be described later in the examples with reference to FIG. 16.

2. EXAMPLES

Hereinafter, with reference to the drawings, embodiments of the present invention will be explained.

2.1 First Embodiment 2.1.1 Schematic Configuration

Figure 11:
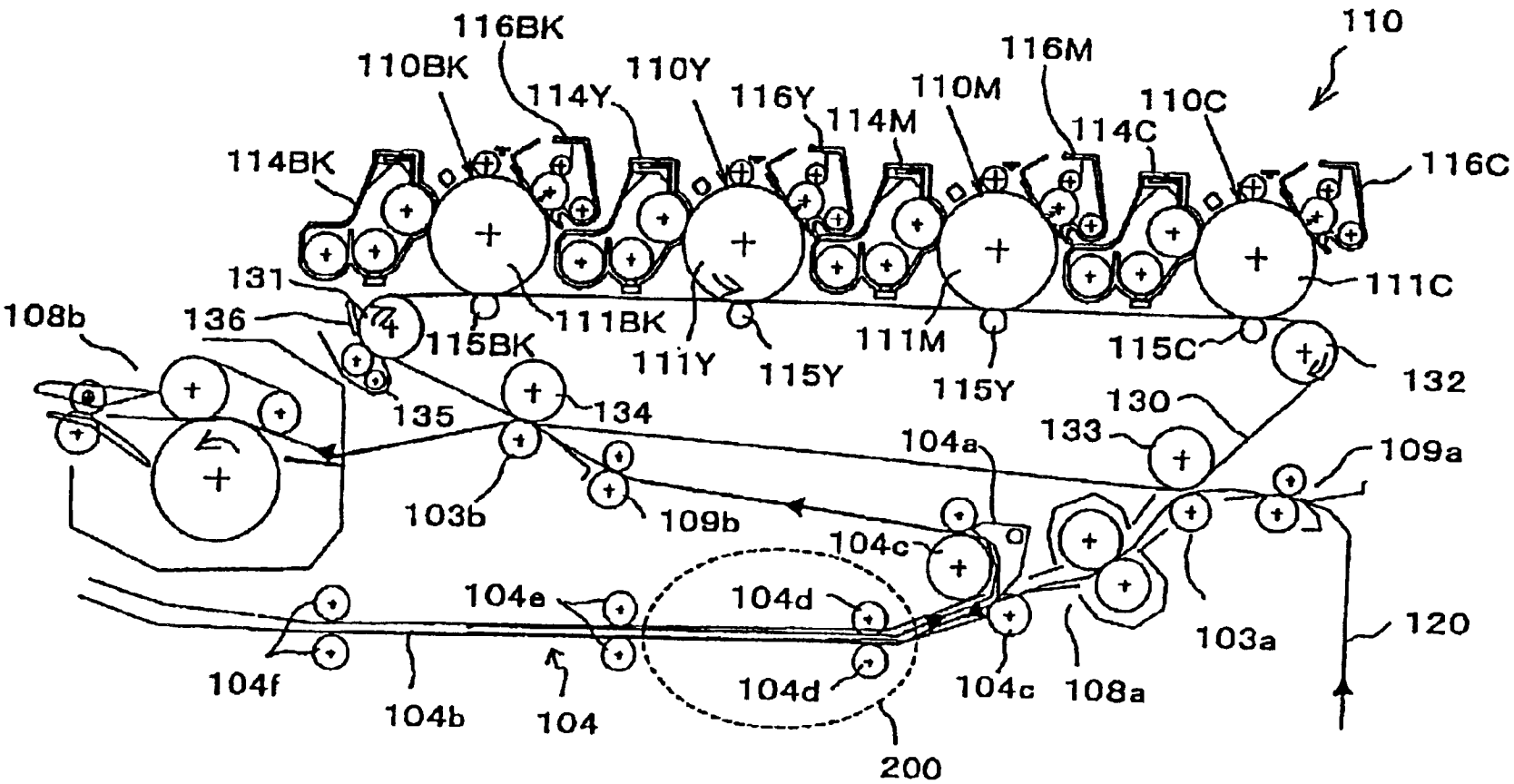
FIG. 11 is a schematic configuration diagram showing a tandem type color image formation device according to an embodiment of the present invention.

FIG. 11 is a schematic diagram showing the configuration of an image producing section of a color laser printer according to a further specific first embodiment of an image formation device of this embodiment. In FIG. 11, the color laser printer according to this embodiment is a color image formation device of the so-called digital tandem type electrophotography method. Since the tandem type electrophotography method color image formation device itself is known, the known part will be explained schematically.

The image producing section of the printer according to the first embodiment comprises an unshown image writing section, an image formation section 110, and a paper feeding section 120. The image wiring section is read out by an unshown scanner (image reading section) so as to be converted to signals of black (Bk), yellow (Y), magenta (M), and cyan (C) colors for image formation by the image process of an unshown image processing section based on the image signal converted to the image data, and sent to an image writing section. In the image writing section, for example, a laser scanning optical system comprising a laser light source, a deflector such as a rotating polygonal mirror, a scanning image forming optical system, and a mirror group, is used. The image writing section will be explained as one using a laser scanning optical system in this embodiment, but in addition thereto, an LED writing system comprising an LED array with a large number of LEDs arranged one-dimensionally or two-dimensionally, and an image forming optical system, or the like, can be used as well. In the image writing section, an image writing operation is executed corresponding to each signal color of Bk, Y, M and C onto a photosensitive member (photosensitive drum) provided for each color having four writing optical paths corresponding to each signal color in the image formation section 110.

The intermediate transfer belt 130 is laid between the driving roller 131 and the driven roller 132, and it is disposed between the photosensitive members 111Bk, 111Y, 111M and 111C, and the transfer devices 115Bk, 115Y, 115M and 115C in the state provided with a predetermined tension by the tension rollers 133, 134. Therebetween, a toner image of each color is transferred and superimposed from the photosensitive members 111Bk, 111Y, 111M and 111C, and the toner visible image on the photosensitive members 111Bk, 111Y, 111M and 111C are held. Moreover, on the driving roller 131 side, an intermediate transfer belt cleaning device 135 and a scraper 136 are provided for cleaning the residual toner on the intermediate transfer belt 130.

A paper is conveyed from the paper feeding section 120 so that the toner image on the intermediate transfer belt 130 is transferred each onto the front surface (first surface) and the back surface (second surface) of the paper by the first transfer section 103*a* and the second transfer section 103*b*. The first transfer sections 103*a*, 103 are provided with a transfer mend explained in the item 1.5 "transfer". Moreover, the first fixation section 108*a* and the second fixation section 108*b* are provided on the downstream side in the paper conveyance direction with respect to the first transfer section 103*a* and the second transfer section 103*b*, respectively. In the first fixation section 108*a*, the first fixation step explained in the item 1.6 "fixation" is carried out, and in the second fixation section 108*b*, the second fixation step is carried out.

Furthermore, a first resist roller pair 109*a*, and a second resist roller pair 109*b* are provided in the conveyance path on the upstream side of the first transfer section 103*a* and the second transfer section 103*b*, respectively for sending out the paper 106 to the first transfer section 103*a* and the second transfer section 103*b* by a timing for positioning with the image on the intermediate transfer belt 130. Details of the tip end resist are as explained in the above-mentioned item 1.7 "registration".

In contrast, the above-mentioned jogger is also used for executing the lateral resist. The jogger 200 is provided at a position shown by the dotted line on the downstream side of the inverting conveyance path 104*b* of the inverting section 140 in FIG. 11 with respect to the conveyance roller pair 104*b*. As shown in the perspective view of FIG. 12, the jogger 200 comprises mainly a pair of jogger fences 201 provided reciprocally movably in the direction orthogonal to the paper conveyance direction with respect to the inverting conveyance path 104*b*, a jogger motor 2*b*3 for moving the jogger fences 201 reciprocally along a slide guide 202, a driving mechanism 204 for transmitting the driving force of the jogger motor 203 and converting the same into a linear reciprocal motion, and a home position sensor 205 for detecting the jogger fences 201 at a home position. The jogger 200 is of the so-called central reference, wherein the pair of the jogger fences 201 move reciprocally with the center of the inverting conveyance path as the reference for alignment of the papers guided by the conveyance roller pair 104 in the direction orthogonal to the conveyance direction.

The jogger fence 205 of the jogger 200 moves to a position of the paper width +10 mm when the start key of the image formation device is turned on, and waits thereat. Then, after having the paper 106 pass through the first fixation section 108*a*, and the rear end of the paper further introduced by the conveyance roller pair 104 pass by the branched nail 104*a*, both fences 205 are moved to the center side to a paper width −1 mm position. By the movement, the aligning operation in the direction orthogonal to the paper conveyance direction is carried out by pushing the side of the paper parallel to the conveyance direction. When the paper aligning operation is finished, it is returned to the paper width +10 mm position, and waits thereat until the paper inversion is finished and the next paper is introduced.

In the case the jogger 200 is provided at the position shown in FIG. 11, since the paper gets off from the nip of the conveyance roller 104*d* serving also as an inversion roller, it cannot be inverted. Therefore, a conveyance roller pair 104*e* rotatable in the forward and backward direction is provided at a position immediately after passing by the nip roller. The conveyance roller pair 104*e* is separated in the case of executing the paper aligning operation (jogging operation) by the jogger 200, and it is pressed by a predetermined pressure after finishing the jogging and at the time of inverting the paper for conveying the paper in the branched nail 104*a* direction so that it is conveyed by the feeding out roller 104*c* along the paper conveyance path 150 to the second resist roller pair 109*b* position.

The inverting section 104 disposed at a stage after the first fixation section 108*a* comprises the unit described in the above-mentioned item 1.3 "inversion" for executing the same function.

2.1.2 Image Formation Section

Figure 13:
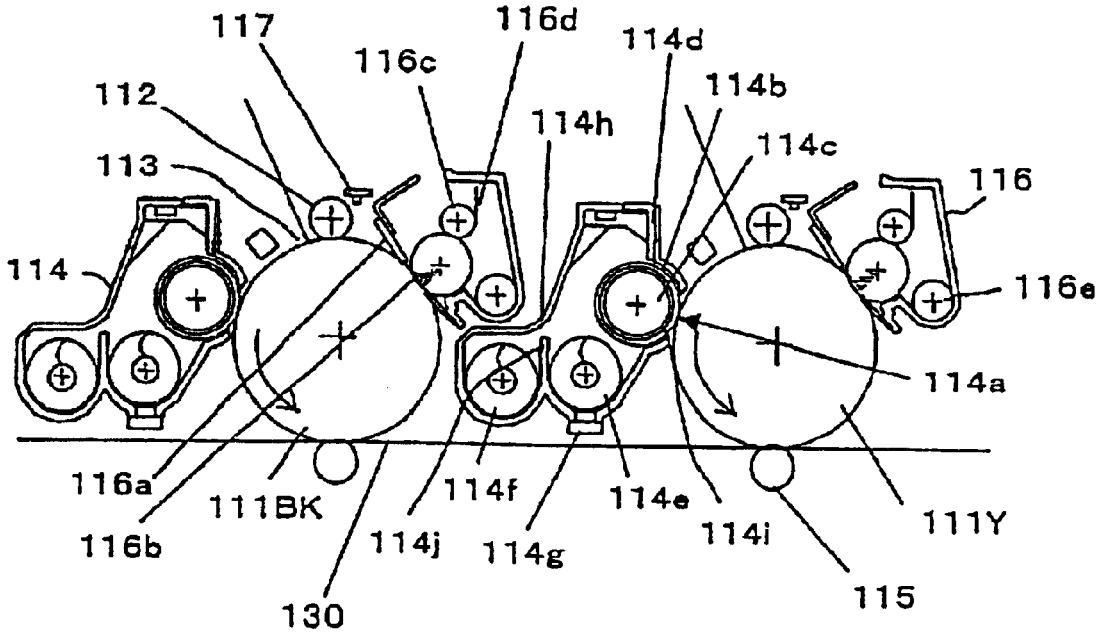
FIG. 13 is a diagram showing the configuration of an image producing process element around a photosensitive member of the tandem type color image formation device shown in FIG. 11.

The image formation section 110 comprise the photosensitive members 111Bk, 111Y, 111M and 111C for black (Bk), yellow (Y), magenta (M) and cyan (C), with an OPC photosensitive member used for the image formation member for each color. The photosensitive members 111Bk, 111Y, 111M and 111C are formed in a drum-like shape. Around the drum-like photosensitive members 111Bk, 111Y, 111M and 111C, as shown in details in FIG. 13, a charging device 111, an exposing section 113 for a laser beam from the writing section, developing devices 114 each for black, yellow, magenta and cyan colors, a first transfer device 115, a cleaning device 116, an electricity eliminating device 117, or the like, are provided. The above-mentioned developing device 114 uses a two component magnetic brush developing method. Moreover, FIG. 13 shows the image formation process elements of the photosensitive member 111 for one color. Since the same configuration is provided for each color, the mark representing the color is omitted for avoiding the complication.

The developing device 114 comprises a developing unit, and the developing unit comprises a developing roller 114*a*, a doctor blade 114*d*, first and second screws 114*e*, 114*f*, a toner concentration sensor 114*g*, and an outer case 114*h*. As to the positional relationship of the developing roller 114*a* and the screws 114*e*, 114*f*, the screws 114*e*, 114*f* are disposed obliquely downward with respect to the developing roller 114*a*, and the first and second screws 114*e*, 114*f* are arranged in the horizontal direction. The outer case 114*h* is provided with a partition plate 114*j* for sectioning the screws 114*e*, 114*f* into two chambers. The deeper side and the front side of the partition plate are notched so as to allow circulation of the developing agent between the two screws 114*e*, 114*f*. Moreover, the outer case 114*h* has the part facing the photosensitive member 111 opened such that a part of the developing roller 114*a* is exposed from the opening section 114*i*. Accordingly, the outer case 114*h* surrounds the developing roller 114*a*, the screws 114*e*, 114*f*, and the doctor blade 114*d* with a relatively large space provided above the first screw 114*e* on the side of the developing roller 114*a* in the figure. The developing roller 114*a* is provided as a roller together with a rotatable non-magnetic developing sleeve 114*b* and a magnet 114*c* as a magnetic field generating unit disposed in the inner side fixed. The developing agent is a two component developing agent containing a non-magnetic toner and a magnetic carrier.

The developing agent is conveyed while being agitated by the two screws 114*e*, 114*f* with the sending directions opposite with each other so as to be circulated in the two chambers sectioned by the partition plate 114*j*. The developing agent being circulated while being agitated and conveyed is supplied to the developing sleeve 114*b* by the first screw 114*e*, held on the surface like a magnetic brush by the magnetic force of the magnet 114*c*, and pumped up in the developing sleeve 114*b* rotation direction. The pumped up developing agent on the magnetic brush is adjusted into an appropriate amount by the doctor blade 114*d*, and sent to the developing section facing the photosensitive drum 111. The residual developing agent after adjustment by the doctor blade 114*d* is dropped outside the magnetic brush-like surface of the developing sleeve 114*b* by the gravity so as to be returned to the screw 114*e*, and it is supplied again to the developing sleeve 114*b* while being agitated and conveyed. This operation is repeated.

In contrast, the developing agent sent to the developing section is visualized by movement of the toner onto the electrostatic latent image on the photosensitive drum 111. The developing agent not used for the visualization is returned into the outer case 114*h*. It is separated from the developing sleeve 114*b* at a part without the function of the magnetic force of the magnet 114*c* so as to be collected in the first screw 114*e*. Accordingly, the developing agent is supplied to the developing sleeve 114*b* while being agitated, conveyed and circulated between the first screw 114*e* and the second screw 114*f*, and collected. Moreover, since the toner concentration becomes thin in the case an image is outputted repeatedly, it is sensed by a toner concentration sensor so that the toner is replenished (not shown) for maintaining a certain concentration.

The cleaning device 116 is for eliminating the residual toner on the photosensitive drum 111 after the first transfer. It comprises a cleaning blade 116*a* of an elastic substance, a fur brush 116*b*, or a combination thereof. In this embodiment, it comprises a cleaning blade 116*a* of an elastic substance, such as a polyurethane rubber, a fur brush 116*b*, an electric field roller 116*c* disposed in contact with the fur brush 116*b*, a scraper 116*d* for the electric field roller 116*c*, and a collecting screw 116*e*. The fur brush 116*b* has the conductivity, and the electric field roller 116*c* is made of a metal.

As to the operation, first, the residual toner on the photosensitive drum 111 is scraped off by the fur brush 116*b* rotating in the counter direction opposite to the rotation direction of the photosensitive drum 111. The toner adhered on the fur brush 116*b* is eliminated by the electric field roller 116*c* rotating in the counter direction with respect to the fur brush 116*b*. The electric field roller 116*c* is cleaned by the scraper 116*d*. At the time, the bias is applied to the electric field roller 116*c*. According to the electrostatic force, the residual toner is moved from the photosensitive drum 111 to the fur brush 116*b*, from the fur brush 116*b* to the electric field roller 116*c*, and finally, it is scraped off by the scraper 116*d* so as to be collected in a waste toner bottle (not shown) by the collecting screw 116*e*, or returned to the developing device 114 for reuse.

The cleaning device 116 and the developing unit 114 are disposed with the positional relationship such that the collecting screw 116*e* portion of the cleaning device 116 is superimposed on the outer case 114*h* of the second screw 114*f* of the developing device 114.

2.1.3 Intermediate Transfer Belt

Figure 14:
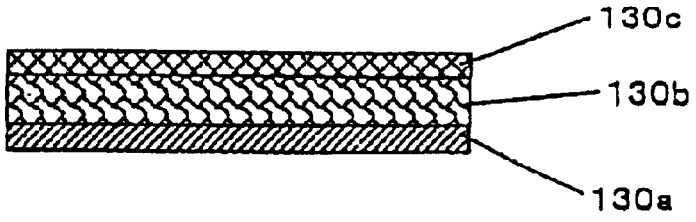
FIG. 14 is a principal section cross-sectional view showing the structure of an intermediate transfer belt used for the tandem type color image formation device shown in FIG. 11.

The intermediate transfer belt comprises an elastic belt. As shown in FIG. 14, a core member 130*a* comprises a hardly stretchable member, such as a resin film made or a urethane resin, a fluorine resin, a polyester resin, a polyethylene resin, a polyimide resin, or the like, and a canvas made of a fiber of a polyethylene, a polyimide, a nylon, or the like. On the core member 130*a*, a soft elastic member 130*b* made of, for example, a fluorine rubber, an acrylonitrile-butadiene copolymer rubber, a polyurethane rubber, a chloroprene rubber, or the like, is laminated, and furthermore, a surface layer 130*c* with a good flat and smooth property, such as a fluorine based resin is coated thereon so as to provide a three layer structure.

2.1.4 Image Forming Operation

This embodiment is a specific embodiment of the above-mentioned conceptual diagrams of FIGS. 1 to 4. In this embodiment, the image formation section 101 corresponds to the image formation section 110, and the image supporting member 102 corresponds to the intermediate transfer belt 130. Although the image supporting member 102 conceptually represents a photosensitive drum in FIGS. 1 to 4, and since an image is visualized by a revolver type developing device, the image supporting member 107 should make a round by four times in order to form a full color image, according to the tandem type device shown in FIG. 11, a full color image can be formed, transferred and fixed during one turn of the intermediate transfer belt, and thus a high efficiency image formation can be enabled.

At the time of the image formation, image information for two surfaces to be formed on both surfaces of a paper is sent to the image processing section continuously or at one time so that the images for the first surface and the second surface of the color corresponding to each image formation section are produced continuously in each image formation section 110Bk, 110Y, 110M, and 110C. The intermediate transfer belt 130 is placed between the photosensitive members 111Bk, 111Y, 111M, and 111C, and the transfer devices 115Bk, 115Y, 115M and 115C so that the toner images of each color are transferred and superimposed from the photosensitive members 111Bk, 111Y, 111M, and 111C, while it passes therethrough so that the toner developed images on the photosensitive members 111Bk, 111Y, 111M, and 111C are supported. Thereby, after passage of the intermediate transfer member 130 through the final image formation section, the images for the first surface and the second surface are formed continuously on the intermediate transfer belt 130.

Then, a paper (corresponding to the above-mentioned mark 106) is fed from the paper feeding section 120 so as to be conveyed to the first transfer section 103*a* via the first resist roller pair 109*a* for the second transfer. At the part the intermediate transfer belt 130 and the second transfer roller of the first transfer section 103*a* come in contact, the first surface image (corresponding to the above-mentioned mark 105*a*) is transferred onto the paper 106 for forming a color image on the paper front surface (corresponding to the above-mentioned mark 106*a*). After the transfer of the first surface (front surface) image 105*a*, the paper 106 is conveyed to the first fixation device 108*a* so that the image is fixed by the first fixation device 108*a* for obtaining a color image. The fixation is the above-mentioned temporary fixation executed at a relatively low temperature.

Thereafter, the paper 106 is introduced into the paper inverting section 104 as the paper front and back surface inverting mechanism so as to be inverted with respect to the front and back surfaces. After adjustment of the paper 106 feeding timing with respect to the second surface image (corresponding to the above-mentioned mark 105*b*) on the intermediate transfer belt 130 via the second resist roller pair 109*b*, it is introduced into the second transfer section 103*b*. At the part the intermediate transfer belt 130 and the second transfer roller of the second transfer section 103*b* come in contact, the second surface image 105*b* is transferred onto the back surface 106*b* of the paper 106 for forming a color image on the paperback surface. The paper 106 after the second surface (back surface) image 105*b* transfer is conveyed to the second fixation device 108*b* so that the image is fixed by the second fixation device 108*b* so as to obtain dual sided color images.

The intermediate transfer belt 130 after finishing the transfer of the first surface and second surface images 105*a*, 105*b* is treated by the intermediate transfer belt cleaning device 135 and the scraper 136 provided on the downstream side with respect tot he second transfer section 103*b* for eliminating the transfer residual toner, and then the next image is formed again in the image formation section 110.

In the case of not executing the dual sided printing, the paper is fed directly to the second resist roller pair 109*b* by an unshown paper feeding path so that the first surface image 105*a* is transferred by the second transfer section 103*b*, and fixed by the second fixation section 108*b* so as to be discharged. Therefore, compared with the case of the dual sided printing, the time from paper feeding to discharging is shorter.

Moreover, in the case the dual sided printing is not executed, it is also possible to elongate the rear end of the paper inverting section 104 to an unshown paper discharging opening as well as to provide a conveyance roller for conveying the paper to the paper discharging opening so that the first surface image is transferred by the first transfer section 103*a*, fixed by the first fixation device 108*a*, and the paper is guided as it is to the paper inverting section 104 so as to be discharged from the paper discharging opening. Also in this case, as mentioned above, since inversion is not necessary, the time from the paper feeding to discharging can be shorter than the case of the dual sided printing. However, the fixation temperature by the first fixation device 108*a* is not a temporary fixation temperature, but it should be raised to the degree capable of the main fixation.

Furthermore, in the case one or both of the first and second transfer mechanisms are provided as the transfer belt type, the conveyance reliability is raised so that a high speed dual sided printing can be enabled. An embodiment thereof is shown in FIG. 15. In this embodiment, transfer belts 103*a*-bt, 103*b*-bt are used for both of the first transfer section 103*a* and the second transfer section 103*b*. As mentioned above in the item 1.12, by using the transfer belts 103*a*-bt, 103*b*-bt, the paper separation reliability can be improved. Although the transfer belts 103*a*-bt, 103*b*-bt are used for both of the first transfer section 103*a* and the second transfer section 103*b* here, it is needless to say that either one of them can be used as well. Since the other parts are same as those of the above-mentioned embodiment shown in FIG. 11, the same parts are provided with the same reference numerals, and redundant explanation is not given.

Figure 16:
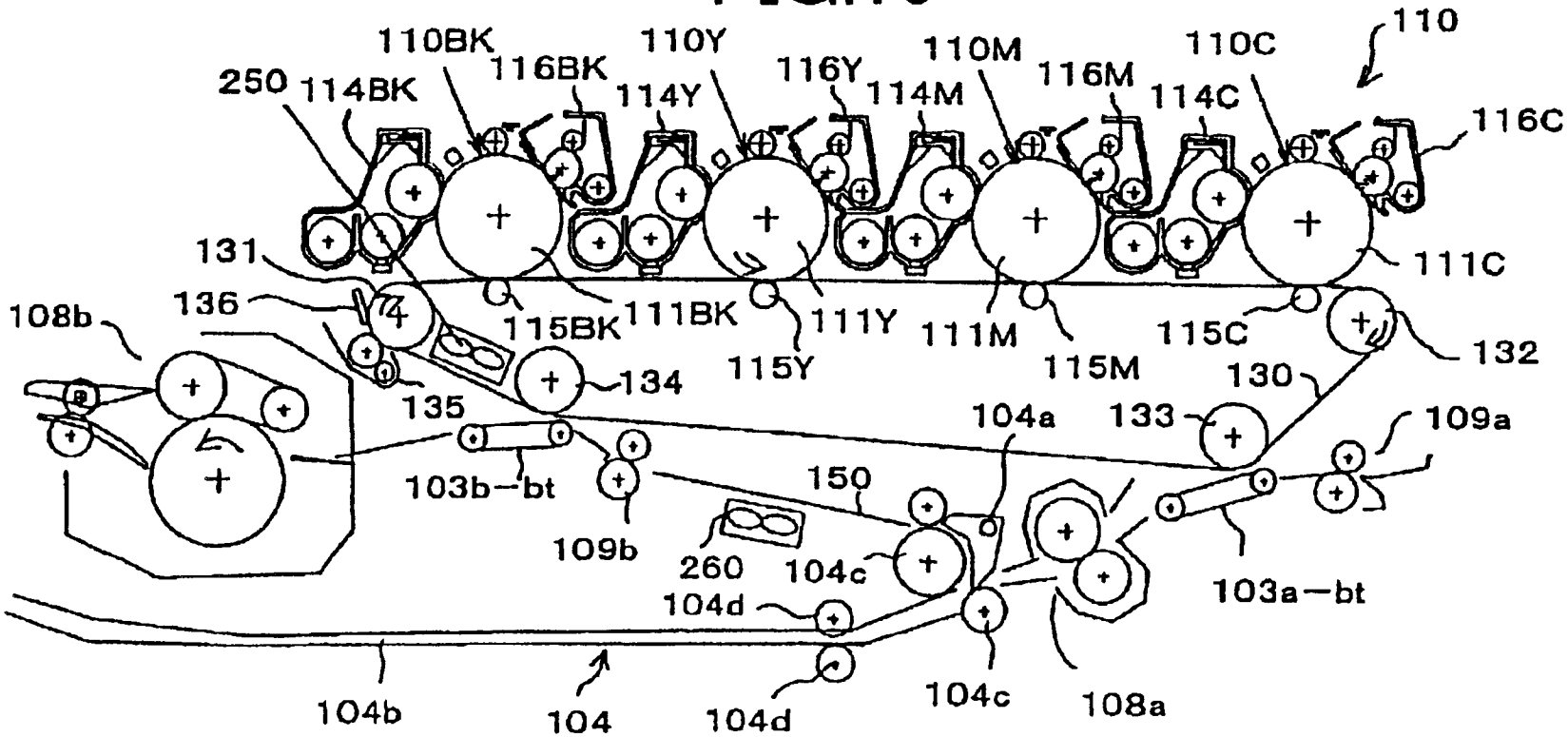
FIG. 16 is a schematic configuration diagram showing an embodiment with a cooling fan provided in the tandem type color image formation device shown in FIG. 11.

Moreover, as mentioned in the above-mentioned item 1.13 "cooling of the image supporting member", heat accumulation in the image supporting member 102 should be avoided. Therefore, in this embodiment, by providing the cooling function for the paper in addition to the image supporting member, generation of a problem by heating the image supporting member by a paper immediately after fixation can be prevented even in the case of the high speed dual sided printing in the configuration of the present invention. This embodiment is shown in FIG. 16. This embodiment is provided with a first cooling fan 250 disposed facing the intermediate transfer belt at the immediately after the second transfer section 103*b* on the intermediate transfer belt 130 rotation direction downstream side for cooling the intermediate transfer belt 130, and a second cooling fan 260 disposed facing the paper conveyance path 150 from the inverting section 104 to the second resist roller pair 109 for cooling the paper being conveyed along the paper conveyance path 150.

According to the configuration, as mentioned in the item of cooling of the image supporting member, heat accumulation in the intermediate transfer belt 130 as the intermediate transfer member can be prevented so that generation of filming of the photosensitive members 111Bk, 111Y, 111M and 111C, or decline of the charging ability can be prevented. According to this embodiment, since the paper 106 is also cooled by the second cooling fan 260, heat conduction from the paper 106 to the intermediate transfer belt 130 can also be prevented, and thus the above-mentioned effect can further be ensured. Although the second cooling fan 260 is provided in this embodiment for cooling the paper 106, it is also possible that only the first cooling fan 250 is provided. However, in this case, it is preferable that the first cooling fan 250 has an ability in consideration of the heat conduction amount from the paper 106 to the intermediate transfer belt 130.

2.2 Second Embodiment 2.2.1 Schematic Configuration

The first embodiment is an embodiment with the present invention adopted in an electrophotography type image formation device using a dry toner. The electrophotography type image formation device using a dry toner is commonly used, and it is advantageous in terms of the image stability, a high writing density, and capability of forming a high quality image. According to the above-mentioned first embodiment configuration, a high speed dual sided printing can be achieved with a high productivity and a low cost.

However, there is a risk of image disturbance at the time of inverting the front and back surfaces of the recording medium after transfer of the first surface of a recording medium by the first transfer unit. In the case a thermal fixation method is adopted for preventing the disturbance, the energy consumption becomes large so that it is difficult to meet the recent demand for energy saving. Therefore, in view of the situation, the second embodiment provides an image formation device capable of restraining the energy consumption as well as achieving a high speed dual sided image production.

In this embodiment, although a developing method using a dry toner is adopted in the first embodiment, a wet type electrophotography method image formation device using a wet toner is adopted. That is, this embodiment relates to a high speed wet type dual sided image production method electrophotography device capable of providing both the blockless property and the high speed property of the electrophotography method in view of the energy saving property of the wet type electrophotography device.

Since an image is transferred onto a recording medium using a developing agent with a toner as a visualizing particle dispersed in a solvent in the wet electrophogotraphy method, the liquid developing agent bonds with the paper surface by its own viscosity as well as the toner and the solvent permeate into the recording medium. Therefore, unlike the case of the dry electrophotography, the characteristic of difficulty in image disturbance by friction, or the like, can be provided. Therefore, since the image can hardly be disturbed at the time of inverting the paper after producing a first surface image and transfer, a device or energy is not required for the image maintaining unit (heating fixation after the first transfer, or the like) needed in the case of the dry electrophotography, and further, a fixation method unique for the liquid electrophotography can be utilized so that an image formation device capable of achieving a high speed dual sided printing at a low energy and a low cost can be realized.

Before explaining the details of this embodiment, the characteristics of this embodiment will be presented.

(1) Use of the Wet Type Electrophotography Method.

In the wet type electrophotography method, owing to the permeation of the solvent to the paper and the viscosity of the developing agent itself, image disturbance can easily be prevented at the time of the inversion.

(2) Use of a Highly Volatile Solvent as the Solvent for the Liquid Developing Agent.

The solvent can be vaporized and permeated further quickly so as to harden the toner image, and thus image disturbance can be prevented.

(3) Use of a Liquid Developing Agent with a Good Permeation Property with Respect to a Paper.

The solvent component can be absorbed and diffused in the paper further quickly so as to harden the toner image, and thus image disturbance can be prevented.

(4) Use of a Liquid Toner Having the Physical Property Including the Hardening Property by the Physical Function.

The toner itself is designed so as to be hardened by the physical function so that the image on the recording paper after the first transfer can be fixed easily so that the image disturbance can be prevented.

(5) Use of the Optical Function as the Above-mentioned Physical Function.

The toner can be hardened with a low energy without contact so that the machine can be produced compactly with energy saved.

(6) Application of an Oil Repellent Agent Fore Repelling a Toner Solvent on the Conveyance Path.

By applying a coating for repelling the toner itself on the part to be in contact with the image surface from the first transfer to the second transfer, toner disturbance by the paper conveyance after the first transfer can be prevented.

2.2.2 Image Producing System

Hereinafter, with reference to the drawings, the second embodiment will be explained. In the explanation below, the part same as those of the above-mentioned embodiments and the first embodiment are provided with the same reference numerals, and redundant explanation is omitted optionally.

Figure 17:
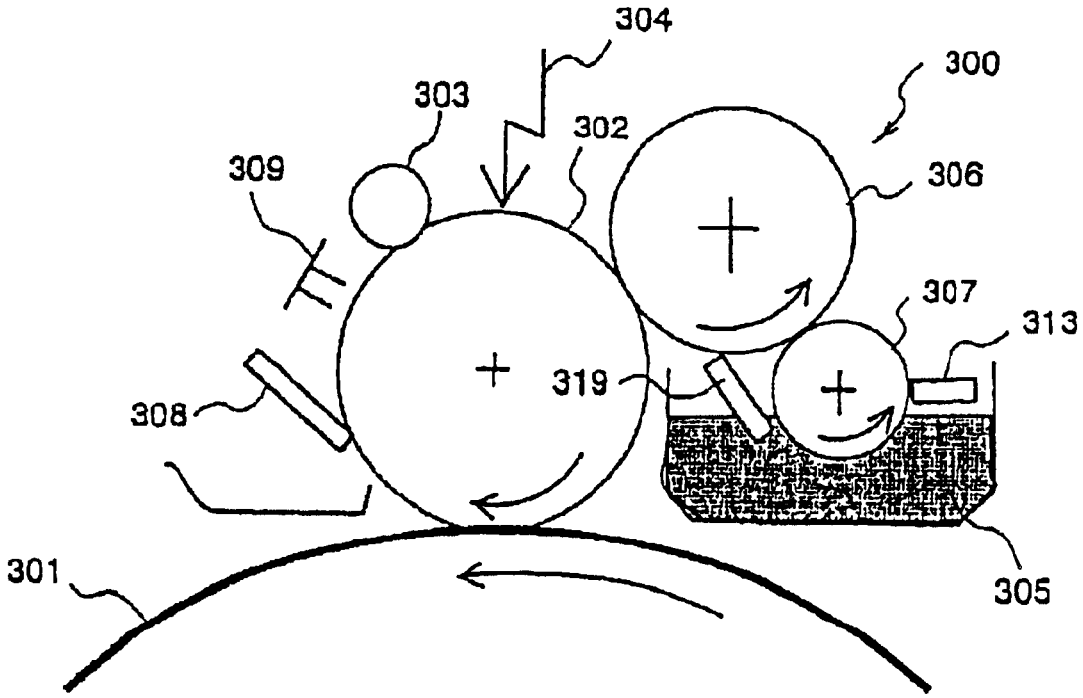
FIG. 17 is an explanatory diagram showing the schematic diagram of an image producing system in a wet electrophotography process according to a second embodiment.

FIG. 17 is a diagram showing the schematic configuration of an image producing system 300 of an image formation device by the wet electrophotography method.

In the figure, around a photosensitive member 302 grounded in contact with an intermediate transfer member 301, a charge roller 303 is contacted and grounded. The charge roller 303 is made of a conductive rubber having a 20 to 70 degree rubber JIS-A hardness, such as an epichlorohydrine rubber, a urethane rubber, an NBR, and an EPDM. The rubber part has about a $10^5$ to $10^{10}$ Ωcm volume resistance. A predetermined bias potential is applied to the charge roller 303 for charging the photosensitive member 302. An AC potential may be superimposed on the bias potential.

The charged photosensitive member 302 is partially exposed by an unshown exposing device (arrow mark 304) so as to form an electrostatic latent image by the loss of the charge potential in the exposing section. Thereafter, the photosensitive member 302 is contacted with a developing roller 306 with a liquid developing agent 305 evenly applied for developing the electrostatic latent image. The developing roller 306 is made of a conductive rubber. In order to obtain a nip with respect to the photosensitive member 302, it has a low hardness of about 10 to 40 degree JIS-A hardness. The liquid developing agent 305 is coated by a rotatable developing agent coating roller 307 to be in contact with the developing roller 306 in the opposite rotating direction. The developing agent coating roller 307 comes in contact with the liquid developing agent 305 at a lower part for holding and pumping up the liquid developing agent 305 on the surface so that the amount of the liquid developing agent 305 on the surface is measured by a necessary amount by a metering blade 313. The developing agent coating roller 307 may be a rubber roller, or in the case the coating amount of the liquid developing agent 305 needs to be measured further accurately, a roller called the gravure roller comprising a metal or resin roller having grooves by a certain interval and a depth on the surface is used as described later. By holding the liquid developing agent 305 in the surface grooves of the roller, and leveling the liquid developing agent 305 adhered on the part other than the grooves by the metering blade 313, the liquid developing agent 305 can be coated always stably.

A cleaning blade 308 and an electricity eliminating lamp 309 are provided facing the outer circumference of the photosensitive member 302 on the down stream side in the photosensitive member 302 rotation direction of the nip of the photosensitive member 302 and the intermediate transfer member 301. The cleaning blade 308 peels off the liquid developing agent 305 remaining on the surface of the photosensitive member 302 without being transferred onto the intermediate transfer member 301. Furthermore, the electricity eliminating lamp (device) 309 eliminates the potential remaining on the photosensitive member 302 surface so that it can be charged at the next step. Moreover, the numeral 319 denotes a cleaning blade to be in contact with the developing roller 306 surface for collecting the residual liquid developing agent 305 on the developing roller 306 surface.

2.2.3 Image Formation Section

Figure 18:
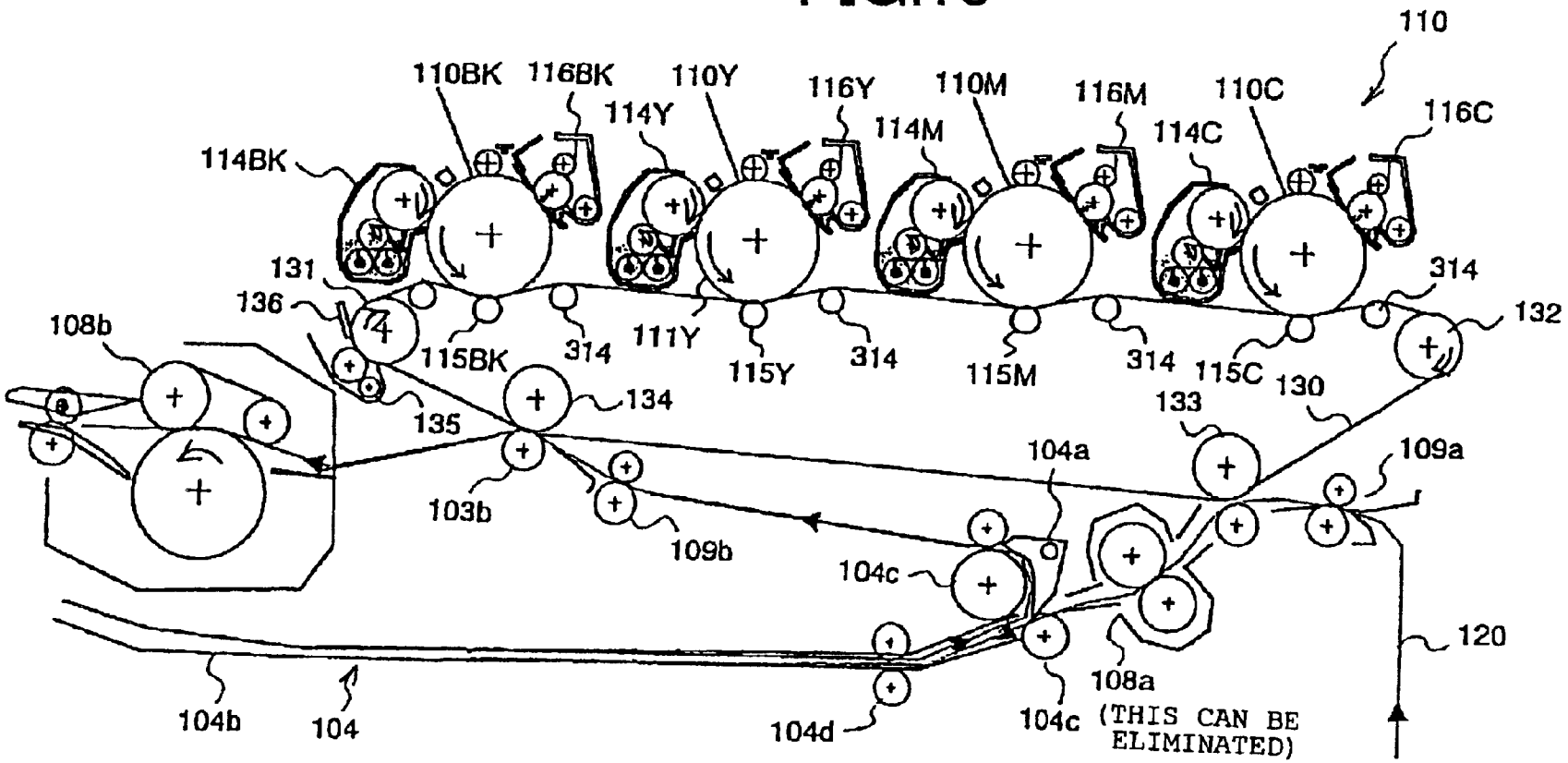
FIG. 18 is a schematic configuration diagram showing a full color image formation section in a wet electrophotography device according to the second embodiment.

FIG. 18 is a diagram showing an image formation section of a full color image formation device with a wet electrophotography method used for the developing method. FIG. 18 corresponds to FIG. 11 of the first embodiment. The same parts are provided with the same reference numerals as mentioned above. Since the photosensitive member and the charge writing are same in either of the wet electrophotography method and the dry electrophotography method, explanation is not given.

Figure 19:
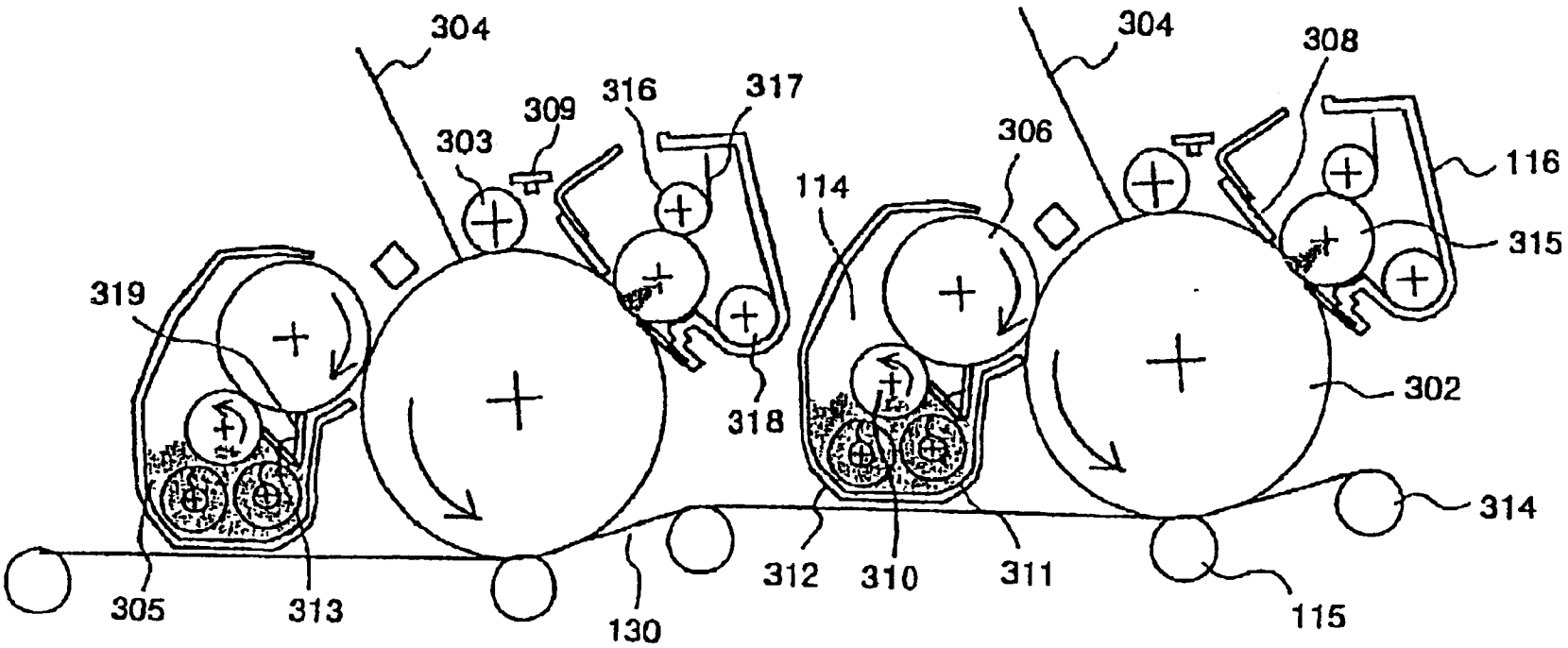
FIG. 19 is a diagram showing the details of the image producing section shown in FIG. 18.

Details of the wet developing unit are shown in FIG. 19 (corresponding to FIG. 13 of the first embodiment). In the figure, the liquid developing agent 305 inside the unit is always agitated by the two screws 311, 312, and it is maintained in the unit to the degree that the lower part of the gravure roller 310 is soaked in the liquid developing agent 305. The gravure roller 310 comprises a roller made of a ceramic, a hard plastic, a metal, or the like, with grooves of a certain depth provided on the surface. It is used for holding the liquid developing agent 305 by a certain amount on the surface. The gravure roller 310 with the lower part soaked in the liquid developing agent 305 is rotated for pumping up the agent according to adherence in the surface grooves. Thereafter, the liquid developing agent 305 is leveled by the metering blade 313 made of a metal or a hard rubber to be in contact with the gravure roller 310 surface by a predetermined amount so as to be measured.

The gravure roller 310 is rotates with the certain amount of the liquid developing agent 305 adhered on the surface so as to come in contact with the developing roller 306 comprising a conductive rubber roller with a low hardness of a 10 to 40 degree JIS-A rubber hardness as mentioned above for coating the liquid developing agent 305 layer onto the developing roller 306 surface evenly as a thin layer. The developing agent thickness at the time is about 5 $\mu$m.

The developing roller 306 is rotated in the same direction as that of the photosensitive member 111. A developing bias is applied to the developing roller 306. According to the bias potential, a latent image on the photosensitive member 111 is developed. In the case an electric field is applied to the thin layer liquid developing agent 305 by the developing bias of the developing roller 306 and the latent image of the photosensitive member 111, the toner in the liquid developing agent 306 generates the electrophoresis so that the image part moves to the photosensitive member 111, and the non-image part moves to the developing roller 306. Since a certain time is needed for the movement, the developing roller 306 is made of a low hardness rubber for ensuring the nip width.

The liquid developing agent 306 includes two components of a solid particle toner and a solvent (carrier) for dispersing and holding the same. In the case the toner is consumed in the developing section, the toner concentration of the developing agent in the developing unit is lowered as well. Therefore, the liquid developing agent 305 is linked with an adjusting unit by a pump so that the liquid developing agent 306 in the inside can be sent to the adjusting unit successively. A circulation adjusting method of adding a high concentration developing agent to the sent liquid developing agent 306 in the adjusting unit which returns the same with a certain developing agent density to the developing unit is adopted. At the time, it is also possible to reuse the toner by returning the transfer residual toner collected by the photosensitive member cleaning unit 308 to the adjusting unit.

The toner developed on the photosensitive member 111 is transferred onto the intermediate transfer belt 130 by the bias electric field from the first transfer roller 115 in the first transfer section. Here, similar to the case of the development, since the toner in the developing agent moves to the intermediate transfer belt 130 by the electrophoresis, time is needed to some extent. Therefore, the nip width is necessary also in the first transfer section as in the case of the development. Then, a roller called an idle roller 314 is provided inside the intermediate transfer belt 130 with respect to the photosensitive member 130, projecting outward with respect to the intermediate transfer belt 130 so that the intermediate transfer belt 130 is wound around on the photosensitive member 111 for ensuring the nip width.

The toner not moved onto the intermediate transfer belt 130 and the carrier remaining on the photosensitive member 111 are agitated by a brush roller 315 to be forced against the photosensitive member 111 so as to be lifted up from the photosensitive member 111 surface, and then cleaned by the urethane blade 308. The cleaned liquid is sent out by the collecting device inside the cleaning unit 116 so as to be sent to the waste toner tank, but it is also possible to reuse the collected agent after returning it to the adjusting unit in the case there is little color mixture, or the like.

The toner image on the intermediate transfer belt 130 is transferred from the intermediate transfer belt 130 to the paper 106 by the second transfer roller of the first transfer section 103*b* with the transfer bias applied by the second transfer section 103. Thereafter, the paper 106 is conveyed to the inverting mechanism 104. At the time, in the case a liquid developing agent 305 with a high solvent volatility and a high self-bonding property is used, unlike the case of the dry toner, since it is fixed by itself according to permeation and volatilization of the solvent without the need of providing a fixation mechanism, the fixing operation needs not be provided before inversion. That is, in FIG. 18, the first fixation section 108*a* can be eliminated.

Figure 20:
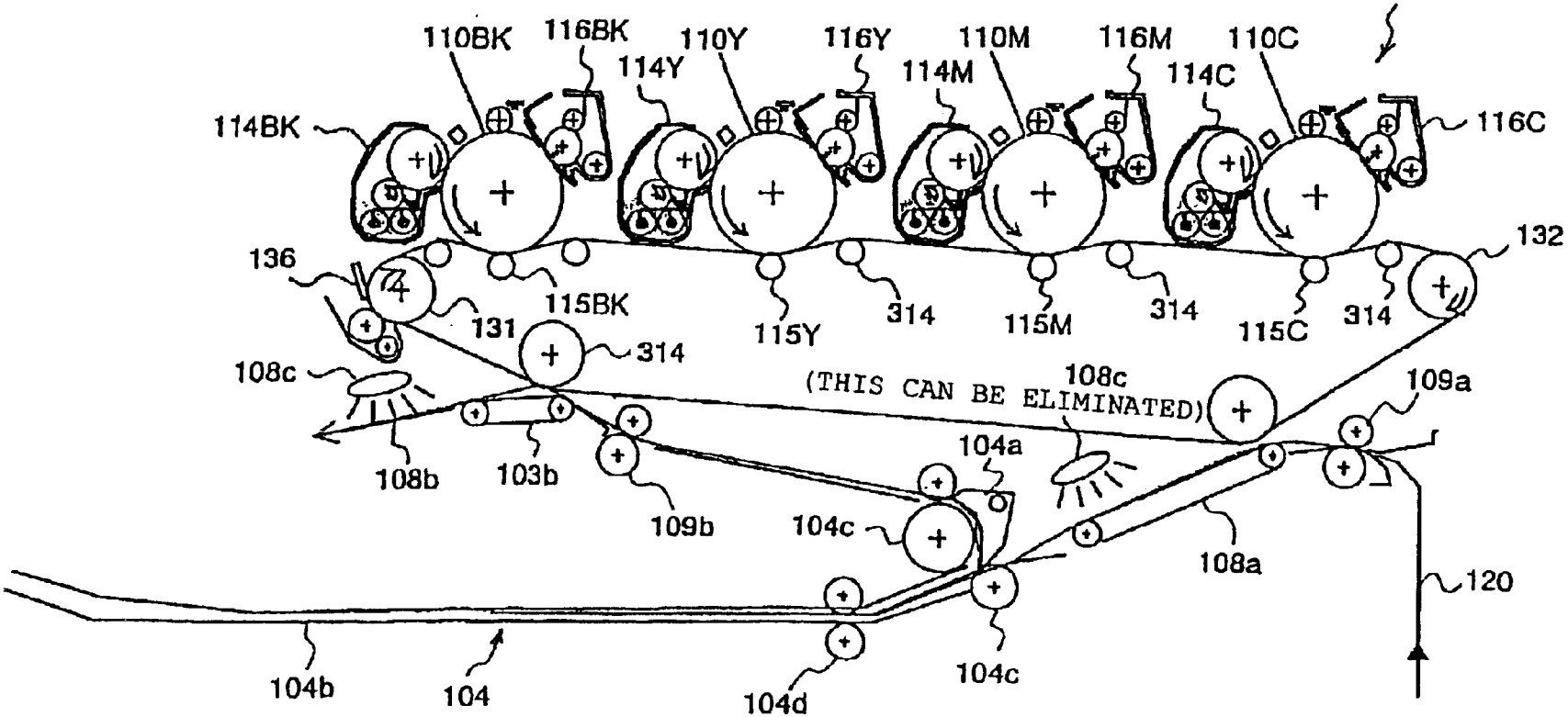
FIG. 20 is a schematic configuration diagram showing a modified embodiment of the second embodiment with the fixing section replaced by a light irradiation device.

In contrast, depending on the kind of the developing agent, some of them have a low self-fixation property. In this case, as in the case of the dry type, it is necessary to fix an image by a heat roller, or the like, to the extent not to be disturbed by the inverting mechanism. Moreover, as the fixing mechanism, in addition to the heat roller, in the case the developing agent has a light hardening property, fixation by an ultraviolet ray irradiating light source 108*c* such as a xenon lamp and a black light can be adopted. An embodiment thereof is shown in FIG. 20.

In FIG. 19, the numeral 316 represents a squeezing roller provided in contact with the fur brush 315. The scraper 317 comes in contact with the squeezing roller 316 for peeling off the liquid developing agent on the squeezing roller 316 surface so as to be collected by the collecting screw 318.

The other parts not explained have the same configuration as in the first embodiment with the same functions.

2.2.4 Liquid Developing Agent

The liquid developing agent 305 used in this embodiment has the following configuration.

The toner particle is prepared by adding a surfactant component such as a metal soap called a CCA for dispersing a pigment or a dye as a coloring agent homogeneously, and controlling the charge characteristics in an oligomer (component A) comprising a monomer represented by the general formula (1) and a ultraviolet ray hardening type monomer or a polymer thereof (component B). The liquid developing agent is prepared by dispersing these components in an electrically insulating solvent.

[Chemical Formula 1]

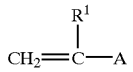

(1)

As an example of the component A, oligomers, such as a lauryl methacrylate, a lauryl acrylate, a stearyl methacrylate, a stearyl acrylate, a 2-ethyl hexyl methacrylate, a 2-ethyl hexyl acrylate, a dodecyl methacrylate, a dodecyl acrylate, a hexyl methacrylate, a hexyl acrylate, an octyl methacrylate, an octyl acrylate, a cetyl methacrylate, a cetyl acrylate, a vinyl laurate, and a vinyl stearate, can be presented.

As a coloring agent, a dye or a pigment, such as a carbon black, an oil blue, an alkaline blue, a phthalocyanine green, a phthalocyanine blue, a spirit black, an aniline black, an oil violet, a benzidine yellow, a methyl orange, a brilliant carmine, a first red, and a crystal violet, can be presented.

An ultraviolet ray hardening type monomer to be polymerized and hardened by a light stimulus (mainly by an ultraviolet ray of a 250 to 400 nm wavelength) is a polyfunctional (having two or more double bonds) monomer. As the polyfunctional monomer, (B1) a divinyl benzene or an alkyl (having 1 to 20 carbon atoms) derivative monomer thereof, (B2) an allyl group containing monomer, (B3) an acrylic or methacrylic monomer, (B4) an amide group containing monomer, or the like, can be presented.

As a specific example of the (B1), an o-divinyl benzene, an m-divinyl benzene, a p-divinyl benzene, a p-methyl divinyl benzene, an o-ethyl divinyl benzene, a p-butyl divinyl benzene, an m-hexyl divinyl benzene, an o-nonyl divinyl benzene, a p-decyl divinyl benzene, an o-undecyl divinyl benzene, a p-stearyl divinyl benzene, an o-methyl divinyl benzene, an o-ethyl divinyl benzene, a p-hexyl divinyl benzene, a p-nonyl divinyl benzene, an m-decyl divinyl benzene, a p-undecyl divinyl benzene, an o-stearyl divinyl benzene, or the like, can be presented.

As a specific example of the (B2), an allyl acrylate, an ally methacrylate, a β-furyl allyl acrylate, an allyl-6-allyloxy tetrahydropyrrane-2-carboxylate, a diethylene glycol bisallyl carbonate, a diallyl maleate, a methyl allyl maleate, a diallyl fumarate, a diallyl itaconate, a diallyl futarate, a triallyl trimellitate, a triallyl cyanurate, a 2-chloroallyl methacrylate, or the like, can be presented.

As a specific example of the (B3), an ethylene glycol diacrylate, an ethylene glycol dimethacrylate, a diethylene glycol diacrylate, a diethylene glycol dimethacrylate, a triethylene glycol triacrylate, a triethylene glycol trimethacrylate, a butane diol diacrylate, a butane diol methacrylate, a 1,6-hexane diol diacrylate, a 1,6-hexane diol dimethacrylate, a trimethylol propane triacrylate, a trimethylol propane trimethacrylate, a tetramethylol methane triacrylate, a tetramethylol methane trimethacrylate, a tetramethylol methane tetraacrylate, a tetramethylol methane tetramethacrylate, a dipropylene glycol diacrylate, a dipropylene glycol dimethacrylate, a trimethylol hexane triacrylate, a trimethylol hexane trimethacrylate, a pentaerythritol tetraacrylate, a pentaerythritol tetramethacrylate, a 1,3-butylene glycol diacrylate, a 1,3-butylene glycol dimethacrylate, a trimethylol ethane triacrylate, a trimethylol ethane methacrylate, or the like, can be presented.

It is preferable to add a photo polymerization initiator in the toner. The photo polymerization initiator (photo sensitizing agent) is a substance easily decomposed by an ultraviolet ray so as to generate a radical. It is for initiating the polymerization by the radial from the photo sensitizing agent by adding the same in at least one of the binder components (component A, component B), and directing an ultraviolet ray thereto after the development.

As the photo sensitizing agent, carbonyl components, such as a diacetyl, a benzyl, a benzophenone, a benzaldehyde and a cyclohexanone, an azobis isobutylonitril, an azo methane, a tetramethyl thiuram disulfide, a dibenzothiazolyl disulfide, a carbon tetrachloride, an organic peroxide, a launyl nitrate, an eosin, an erythrosin, a neutral red, a victria blue, or the like, can be presented.

The toner particle containing these components is dispersed in an electrically insulating solvent so as to provide a liquid developing agent. As the solvent, an ore oil, a plant oil such as a castor oil, and a derivative thereof, such as a peanut oil, a corn oil, a coconut oil, a rapeseed oil, or the like, can be presented. Moreover, a high boiling point hydrocarbon, such as Isoper V, Isoper L, and Isoper H produced by Exson Chemical Corp., a silicone oil, such as KF 96 produced by Shinetsu Silicone Corp., a dry oil, such as a linseed oil, an ether based solvent, such as a polyethylene glycol, and a polypropylene glycol, can be used as well.

The binder used for the liquid toner according to this embodiment contains mainly the above-mentioned component A and component B. As the most preferable embodiment thereof, (A) a combination of a copolymer of the component A and the component B, and the monomer component A, and (B) a combination of a copolymer of the component A and the component B, and the monomer component B, can be presented.

Such a copolymer can be obtained by thermal polymerization of the monomer A and the monomer B in an aliphatic hydrocarbon solvent in the presence of a polymerization initiator such as a benzoyl peroxide, and an azo bisisobutylonitrile.

2.2.5 Production Method for the Liquid Developing Agent

The liquid developing agent used in this embodiment can be produced, in general, by mixing 0.5 to 5 parts by weight of a binder component (component A, component B) with 1 part by weight of a coloring agent, and sufficiently dispersing the same in the presence of 10 to 20 parts by weight of a diluting solvent by a dispersing machine such as an attriter, a ball mill, and a keddy mill so as to provide a liquid toner.

2.2.6 Fixation

As mentioned above, since the binder component for the liquid developing agent according to this embodiment is of an ultraviolet ray hardening type, the toner can be fixed easily by the ultraviolet ray irradiation (300 to 400 nm). Moreover, as mentioned above, the ultraviolet ray irradiating device 108*c* can comprise a lamp, a reflection plate, a lamp housing, a light source section, or the like.

According to development and fixation (ultraviolet ray irradiation) with the ultraviolet ray hardening type wet toner used in this embodiment, a high speed copying by 70 pieces or more per minute of A-4 size can be enabled. However, by containing an ultraviolet ray absorbing agent in the toner, the fixation can be carried out further efficiently so as to enable a further high speed copying. Since the ultraviolet ray absorbing agent functions also as a discoloring preventing agent so as to provide an image with a good light resistance, it is advantageous to add the same.

As a specific example of the ultraviolet ray absorbing agent, a p-dimethyl amino benzaldehyde,
a p-dimethyl amino benzoic acid,
a p-dimethyl amino acetophenone
an N-methyl N,β-chloroethyl amino benzoaldehyde
a 4,4'-bis(diethyl amino) benzophenone
a p-chloro benzophenone
a p, p-dichloro benzophenone
Irugacure 651 (produced by Chibagaigi Corp.)
Irugacure 184 (produced by Chibagaigi Corp.)
Darocure 1116 (produced by Merc Corp.)
Darocure 1173 (produced by Merc Corp.)
a 4-benzoyl-diphenyl ether
a 4-benzoyl-4'-methyl diphenyl ether,
a 4-benzoyl-4'-ethyl diphenyl ether
a 4-benzoyl-4'-methoxy diphenyl ether, a 4-benzoyl-4'-chloro diphenyl ether
a 4-p-toluoyl-4'-methyl diphenyl ether
a 4-benzoyl-3',4'-dimethyl diphenyl ether
a 4-benzoyl diphenyl sulfide
a 4-benzoyl-4'-methyl diphenyl sulfide
a 4-p-toluoyl-4'-methyl diphenyl sulfide
a benzo phenone
a benzoyl methyl ester benzoate
a benzoin ethyl ether
a benzoin isopropyl ether
a benzoin isobutyl ether
a benzyl
a xanthone
a 2-methyl thioxanthone
a 2-isopropyl thioxanthone
a 2-chloro thioxanthone
Countercure MBP (produced by Watoprekinsop Corp.)
Coutercure RTX (produced by Watoprekinsop Corp.)
Kayacure MBP (produced by Nihon Kayaku Corp.)
Kayacure RTX (produced by Nihon Kayaku Corp.)
Kayacure DITX (produced by Nihon Kayaku Corp.)
Kayacure DMBI (produced by Nihon Kayaku Corp.)
Nissocure EMA (produced by Shin Nisso Kako Corp.)
Baicure 55 (produced by Sutoufar Chemical Corp.)
Sandorei 1000 (produced by Sando Corp.)
Acetocure INPP (produced by Acetochemical Corp.)
Trigonal 12 (produced by Akuzokemi Corp.)
DEAP (Produced by Appujon Corp.), or the like, can be presented.

The content of the ultraviolet ray absorbing agent is 20% by weight or less, preferably 0.1 to 5% by weight with respect to the toner component. As the method for adding the ultraviolet ray absorbing agent, dispersion in a polymer solvent, adsorption on a pigment, or addition to a photo polymerization initiator at the time of preparing the toner, or the like, can be used.

2.2.7 Image Stability at the Time of Inversion

Also in the second embodiment, after the image transfer of the first surface image 105*a* onto the paper front surface 106*a*, the first surface image 105*a* transferred on the paper 106 should be kept without disturbance until the second surface image 105*b* is transferred onto the paper second surface 106*b* so as to be discharged to the outside of the machine. In particular, since the paper needs to be inverted after the first transfer step in this embodiment, it is highly liable that the first surface image 105*a* is rubbed.

However, since the image formation method in this embodiment is a wet type electrophotography method, as mentioned above for the wet type electrophotography method characteristics, the liquid developing agent has a self-fixation property in the recording medium so that image disturbance can hardly be generated. However, in the case it is rubbed with a strong pressure, even though it is a wet electrophotography, there is a risk of image disturbance.

In order to solve the problem, as mentioned above, a component to be hardened by the physical function can be included as the developing agent component. In general, a fixation method of polymerization reaction or melting the toner resin in the developing agent by heating or pressure is used commonly. However, in addition thereto, as mentioned above as the developing agent component example, in the case the developing agent binder component has an ultraviolet ray hardening property, the toner can be fixed easily by the ultraviolet ray irradiation (300 to 400 nm).

Since the hardening by the photo function is highly advantageous in terms of (1) the non-contact property,
(2) the high speed property, and
(3) the energy saving property, it is highly suitable for the present method aiming at a high speed dual sided image production with energy saved.

Specifically, after the first surface image transfer to the paper 106 at the first transfer step in FIG. 1, an ultraviolet ray is directed to the image on the paper 106 using a high pressure mercury lamp, a black light, an ultraviolet LED, an ultraviolet LD, or an ultraviolet ray utilizing the non-linear optical effect, or the like so as to harden the toner. At the time, the main purpose of the fixation step after the first transfer step is to prevent the first surface image disturbance until the second transfer step is finished, and thus it is not necessary to completely fix the toner in this stage.

As other characteristics of the case of using the wet type electrophotography method as mentioned above, the self-fixation property can be presented. In the case of a liquid developing agent, the toner itself has the viscosity so that in combination with the effect of the solvent of permeating and diffusing in the paper, it can be entangled well with the paper fiber, and thus it can be fixed only by drying. Therefore, by raising the permeation, diffusion, and drying speed of the solvent in the paper, the self-fixation property can further be improved.

The permeation property of the liquid developing agent 305 with respect to the paper 106 is influenced by the viscosity and the surface energy of the solvent. As the solvent for the liquid developing agent 305, one having about a 0.1 to 1,000 cSt (centistokes, unit of the static viscosity) viscosity is used. However, those having a high viscosity has an extremely low permeation property with respect to the paper. Therefore, by use of a solvent with a low viscosity of 100 cSt or less, the developing agent can be hardened further quickly. Moreover, the surface energy of the solvent is also important. Also by use of a solvent with a low surface energy, such as a dimethyl silicone oil, the developing agent can be hardened easily.

Moreover, also in terms of volatilization, by use of a low viscosity solvent, hardening can be facilitated. For example, the above-mentioned dimethyl silicone oil has the viscosity varied depending on the molecular weight. One having a lower molecular weight has a lower viscosity, and thus one having a lower molecular weight has more volatile component. Therefore, it is preferable to use one with a lower molecular weight in terms of the self-fixation of the developing agent on the paper. However, on the other hand, in the case the volatility is too high in an ordinary temperature state, it is problematic in terms of storage of the developing agent in the machine. That is if the volatility is too high in an ordinary temperature state, since the solvent is vaporized in the machine so as not to provide the developing characteristics, or generate adhesion, it is preferable to use in the state of containing a slight amount of about 5 cSt of the volatile component in the actual practice.

Furthermore, a method for preventing the first surface image disturbance in the path, unique for the wet type electrophotography can be provided. In general, substances with different surface energies have a large interface energy functioning on the interface thereof. For example, like water and oil, they repel with each other so as not to wet with each other. Therefore, by coating a substance having an oil repellent (developing agent repellent) property on a part on the paper that is to be in contact with the developing agent, even in the case the developing agent contacts with the part, they repel with each other so that disturbance of the image by adhesion or dropping of the developing agent can be prevented. Therefore, by Unidain TG-590 produced by Daikin Kogyo Corp. having a surface energy smaller than the surface energy of the developing agent containing a dimethyl silicone as the solvent being used was coated. Consequently, a good mold releasing property was provided so that the toner was not transferred even if it was contacted with a paper having the developing agent placed. In the case of the powdery substance such as the dry electrophotography, since they are solid substances, the function is small.

2.2.8 Superiority of the Wet Electrophotography Method with Respect to the Dry Method The image production method described in this embodiment is the wet electrophotography method. As mentioned above, the wet type electrophotography method is a method of developing an electrostatic latent image with a toner as a coloring charged particle dispersed in a liquid solvent, and transferring an image directly from the latent image supporting member to a paper, or to a paper via an intermediate transfer member. It has the following advantages with respect to the dry type electrophotography method.

(1) Good Image Quality

A toner commonly used in the dry type electrophotography has about a 7 to 10 $\mu$m average particle size, and a toner of 6 $\mu$m or less provides a poor yield in a pulverization method so as to raise the cost. Moreover, since a small particle size dust gives rise to the pneumoconiosis with the serious influence on a human body, and thus it cannot be used. In contrast, in a liquid developing agent used in a wet electrophotography process, since the toner particle is taken in a solvent, a small particle size (particle size of a sub $\mu$m order) can be obtained by a means of ball mill, or the like, without a problem of dust at a relatively low cost. Therefore, a highly accurate image can be obtained by accurately developing the latent image without toner scattering occurred in the dry type toner.

(2) Low Fixation Cost

In general, in the case of the dry electrophotography, a heating and melting fixation method is used. This is a method of heating a dry type toner resin to a softening point temperature or higher so as to be melted and deformed, and entangling and fixing the same to a paper fiber. Therefore, it is necessary to heat to the toner resin softening point temperature or higher, and thus it is an extremely high cost fixation method. In contrast, in the case of a liquid developing agent, since the toner itself has a viscosity, and in combination with the effect of the solvent of permeating and diffusing in the paper, it can entangle well with the paper fiber so as to be fixed only by drying. Moreover, by designing the solvent specially, the toner resin can be hardened as mentioned above by the physical stimulus (such as the ultraviolet ray irradiation), and thus the fixation can be carried out without depending only on the heating fixation.

(3) Small Toner Layer Thickness

In the dry type electrophotography, due to the large particle size, the toner layer thickness on the paper should be thick. In contrast, in the wet type electrophotography, since the toner particle size is small, the toner layer thickness on the paper can be made smaller. As a result, the risk of disturbance of image by friction can be reduced in the case a member and the image before fixation are contacted.

Owing to these characteristics, as in the second embodiment, the image disturbance at the time of the paper inversion after the first transfer can be presented so that a dual sided image formation device capable of forming dual sided images at a high speed with the energy saved, can be obtained.

3. Other Image Formation Methods

Although an image formation method such as an electrophotography method is adopted in the image formation devices described so far for forming an image on an image supporting member, and executing the toner development and the transfer, by using a wet type electrophogotraphy method, and an ink jet method instead of the electrophotography method, dual sided images can be obtained with little blurring at a high speed without the need of providing a fixation mechanism.

Moreover, by using a toner jet method, compared with the electrophotography method, high speed dual sided printing can be enabled with the space saved, without the need of providing the electrostatic latent image production step, or the developing step.

Furthermore, by using an ion flow method, the photosensitive member can be charged selectively so as to form an image without the need of using a complicated latent image formation device so that high speed dual sided printing can be enabled.

Moreover, by using a magnetography method, an image can be formed directly without the need of using a complicated latent image formation device so that high speed dual sided printing can be enabled.

As heretofore described, according to the present invention, the following advantages can be provided.

That is, according to the first aspect, since the unit which transfers an image from an image supporting member to a recording medium are formed at two points on the same image supporting member, and the recording medium is inverted with respect to the front and back surfaces by an inverting unit using an inverting path while conveying the recording medium from the first transfer unit to the second transfer unit, dual sided printing can be enabled while having the image on the image supporting member passes through the two transfer steps, and thus the dual sided printing productivity can be improved particularly for the first print.

According to the second aspect, since the image formation unit onto the image supporting member is of the electrophotography method, dual sided printing can be carried out at a high speed in the highly reliable method most commonly used in the offices.

According to the third aspect, since an intermediate transfer unit which transfers the visualized image developed by the developing unit onto an intermediate transfer member is included, it can be adopted to one of an intermediate transfer method, in addition to one of a direct transfer from the photosensitive member, and thus a wide range utilization can be enabled.

According to the fourth aspect, in addition to the electrophotography method, it can be adopted also in an image formation device of the ink jet method, the toner jet method, the ion flow method, and the magnetography method, and thus a wide range utilization can be enabled.

According to the fifth aspect, since two surface images of a first surface image and a second surface image are formed on the image supporting member, the first surface image is transferred onto the first surface of the recording medium by the first transfer unit, the recording medium is inverted with respect to the front and back surfaced while conveyance of the recording medium from the first transfer step to the second transfer step, and the second surface image is transferred onto a back surface of the recording medium after the first surface transfer at the second transfer step, dual sided printing can be executed at a high speed.

According to the sixth aspect, since the image formation unit is of a wet electrophotography method, comprising a latent image formation unit which forms an electrostatic latent image, and a developing unit which visualizes the formed electrostatic latent image with a liquid developing agent containing a toner as a visualizing particle dispersed in a liquid solvent, image disturbance can be restrained at the time of inversion owing to the permeation of the solvent to the paper, and the viscosity of the developing agent itself.

According to the seventh aspect, since the liquid developing agent has a characteristic to be cured by a predetermined physical function, image fixation on the recording paper after the first transfer can be executed easily, and thus the image disturbance can be restrained.

According to the eighth aspect, since the image formation unit includes an intermediate transfer unit which transfers the visualized image developed by the developing unit onto an intermediate transfer member, the wet type electrophotography method can be introduced into an image formation device using an intermediate transfer member, and thus development to the multi-color image formation can be facilitated.

According to the ninth aspect, since a unit which hardens the first surface image transferred on the first surface of the recording medium by the first transfer unit by a predetermined physical function is provided, the image fixation on the paper after the first transfer can be facilitated, and thus the image disturbance can be restrained.

According to the tenth aspect, since the hardening is carried out by an optical function, the toner can be hardened with a low energy without contact, the machine can be provided compactly with the energy saved.

According to the eleventh aspect, since the solvent of the liquid developing agent is volatile, the solvent can vaporized and permeated further quickly so as to harden the toner image, and thus the image disturbance can be restrained.

According to the twelfth aspect, since the solvent of the liquid developing agent is permeable to the recording medium, the solvent component can be absorbed and diffused in the paper further quickly so as to harden the toner image, and thus the image disturbance can be restrained.

According to the thirteenth, since a substance having a surface energy lower than the surface energy of the liquid developing agent is coated on a member to be contacted with the first surface image transferred onto the recording medium, between the first transfer unit installation position and the second transfer unit installation position, the toner can hardly be disturbed by the paper conveyance after the first transfer.

According to the fourteenth aspect, since the outer circumference of the image supporting member is set at least by a length of {(the first surface image length)+(the second surface image length)+(inverting time by the inverting unit)×(image supporting member speed)}, high speed dual sided printing can be enabled even in the case time is needed for the paper inversion in a revolver developing type color machine.

According to the fifteenth aspect, since the image supporting member comprises a photosensitive member or an intermediate transfer member, the machine can be designed in a cost saving and space saving configuration by applying the present technique in the former, and a high color superimposing accuracy and a high driving accuracy of a color image can be provided in the latter, and thus in either case high speed dual sided printing can be enabled highly accurately.

According to the sixteen the aspect, since the image supporting member is formed in a drum-like shape, or a belt-like shape, the color superimposing accuracy of a color image can be improved and thus the driving accuracy is improved as well so as to obtain a highly accurate color image in the former, and a high layout freedom can be enabled in the machine configuration and a good paper separation characteristic from the image supporting member can be provided, and thus a high speed dual sided printing system can be achieved in the latter.

According to the seventeenth aspect, since the developing unit is provided by one or more, high speed dual sided printing of a color image can be enabled.

According to the eighteenth aspect, since the image producing unit in contact with the intermediate transfer member is provided by one or more, high speed dual sided printing of a color image can be enabled.

According to the nineteenth aspect, since one or more photosensitive members are contacted with the intermediate transfer member for executing the intermediate transfer, high speed dual sided printing of a color image can be enabled.

According to the twentieth aspect, since one or more developing unit are provided with respect to the photosensitive member for executing the developing operation, high speed dual sided printing of a color image can be enabled.

According to the twenty first to twenty six aspects, since at least the second surface image on the image supporting member can not be disturbed after the transfer of the first surface image, high speed dual sided printing can be enabled without image disturbance.

According to the twenty seventh aspect, since the image fixation is executed simultaneously with transfer at either of or both of the two transfer steps, high speed dual sided printing can be enabled without image disturbance.

According to the twenty eighth aspect, since first and second fixation unit each for executing fixation immediately after the end of the transfer step of the first and second transfer unit are provided, and the thermal amount provided to a paper by the first fixation unit is set at an amount smaller than the thermal amount provided to the recording medium by the second fixation unit, fixation can be carried out at the first fixation step without excessive elimination of the paper water content, and high speed dual sided printing can be enabled without the image disturbance while preferably maintaining the second surface transfer.

According to the twenty ninth aspect, since the thermal amount in the first fixation unit is set in a range without generating the cold offset, fixation can be carried out in the first fixation unit at a low temperature not to disturb the image without excessively elimination of the paper water content, and high speed dual sided printing can be enabled without the image disturbance while preferably maintaining the second surface transfer.

According to the thirtieth aspect, since the first fixation unit comprises a fixation device including a heating member having a heat generating member, a film in contact with the heating member, and a pressuring member in contact with the heating member with pressure via the film, for heating and fixation by passing a recording medium with an unfixed image formed between the film and the pressuring member, high speed dual sided printing can be enabled without the image disturbance by reducing the time needed for raising the fixation temperature.

According to the thirty first aspect, since a tip end resist unit which matches a predetermined position in the conveyance direction of the recording medium to be conveyed into the second transfer unit, and the image tip end of the second surface image, is provided, high speed dual sided printing can be enabled with a good positioning accuracy of the dual sided images.

According to the thirty second aspect, since a lateral resist adjusting unit which matches the recording medium in the direction orthogonal to the conveyance direction between the first transfer unit and the second transfer unit, is provided, high speed dual sided printing can be enabled with a good positioning accuracy of the dual sided images.

According to the thirty third aspect, since a conveyance path for passage of the recording medium is set only in the first transfer unit or the second transfer unit at the time of forming an image only on one surface, a high speed dual sided printing machine with a high productivity also at the time of one side printing can be provided.

According to the thirty fourth aspect, since the interval between the first surface image and the second surface image is set by (the time necessary for inversion of the recording medium)×(the moving speed of the image supporting member) or more, even in the case time is needed for the inversion, the paper tip end and the second surface image are positioned at the second transfer step position, and thus high speed dual sided printing can be enabled highly accurately.

According to the thirty fifth aspect, since the conveyance speed of the recording medium to be conveyed to the second transfer unit after the image transfer by the first transfer unit is set at a speed higher than the linear speed of the image supporting member in the rotational direction, the time needed for the paper inversion can be reduced, an thus high speed dual sided printing with a high productivity can be enabled.

According to the thirty sixth aspect, since at least one of the first transfer unit and the second transfer unit comprises a transfer belt, the conveyance reliability is improved, and thus high speed dual sided printing can be enabled.

According to the thirty seventh aspect, since a cooling unit which cools the image supporting member, is provided, generation of a problem by having the image supporting member heated by the paper immediately after the fixation can be prevented even in the case of high speed dual sided printing, and thus stable image formation can be expected.

According to the thirty eighth aspect, since an interleaf mechanism is provided, even in the case the time needed for the paper inverting mechanism is prolonged due to a machine configuration problem, high speed dual sided printing can be enabled.

According to the thirty ninth aspect, since image formation is executed by comprising an image formation step of forming a plurality of images on the image supporting member, a first transfer step of transferring one image on the image supporting member on a first surface of a recording medium, an inverting step of inverting the front and back sides of the recording medium with the image transferred onto the first surface at the first transfer step, and a second transfer step of transferring another image on the image supporting member onto a second surface of the recording medium with the front and back sides inverted at the inverting step, dual sided printing can be enabled while having the image on the image supporting member pass through the two transfer steps, and thus the dual sided printing productivity can be improved particularly in the first print.

According to the fortieth aspect, since an further different image is formed between the one image and the other image, high speed dual sided printing can be enabled by interleaving.

According to the forty first aspect, since a function of accumulating the image data at least for one screen is provided, high speed dual sided printing can be enabled without breakage even in the case of executing the interleaf.

According to the forty second aspect, since the time for reading both surfaces of the manuscript of the image reading device is set at the time for exposing the dual sided images on the image supporting member or less in a system comprising an image reading device, the reading side can follow the high speed of the image formation device side sufficiently, and thus high speed dual sided printing can be enabled.

The present document incorporates by reference the entire contents of Japanese priority documents, 2000-365397 filed in Japan on Nov. 30, 2000 and 2001-287513 filed in Japan on Sep. 20, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image formation device for forming an image on an image supporting member by an image formation unit, comprising:

first and second transfer units which transfer an image formed on the same image supporting member to a recording medium having front and back sides;

an inverting unit which inverts the front and back sides of said recording medium by an inverting path while conveying said recording medium from the first transfer unit to the second transfer unit, the inverting unit including a branched nail and conveyance rollers, wherein the image formation unit forms first and second surface images, the first transfer unit transfers the first surface image onto a first surface of said recording medium, and the second transfer unit transfers the second surface image onto a second surface of said recording medium inverted by the inverting unit; and a maintenance unit which maintains the first surface image transferred onto the first surface of said recording medium by the first transfer unit and prevents disturbance at the time of inverting the recording medium.

2. The image formation device according to claim 1, wherein the image formation unit comprises:

a latent image formation unit which forms an electrostatic latent image; and a developing unit which develops the formed electrostatic latent image with a toner as a developing particle.

3. The image formation device according to claim 2, wherein the image formation unit includes an intermediate transfer unit which transfers the electrostatic latent image developed by the developing unit onto an intermediate transfer member.

4. The image formation device according to claim 2, wherein the developing unit includes one or more developing units.

5. The image formation device according to claim 3, wherein one or more image producing units are in contact with said intermediate transfer member.

6. The image formation device according to claim 5, wherein one or more photosensitive members are contacted with the intermediate transfer member for executing said intermediate transfer.

7. The image formation device according to claim 6, wherein the developing unit includes one or more developing members for each of said one or more photosensitive members for executing a developing operation.

8. The image formation device according to claim 1, wherein the image formation unit is configured to form an image by one of jetting a charged toner, or selectively adhering a thin layer of a magnetic toner.

9. The image formation device according to claim 1, wherein the first transfer unit comprises a non-contact transfer unit which transfers only the first surface image onto the first surface of said recording medium without influencing the second surface image.

10. The image formation device according to claim 1, wherein the first transfer unit is configured to be separable from the image supporting member after the first surface image is transferred onto the first surface of said recording medium from the image supporting member while the second surface image passes by a position of said first transfer unit.

11. The image formation device according to claim 1, wherein the maintenance unit comprises a heating fixation unit which fixes the first surface image of said recording medium.

12. The image formation device according to claim 11, wherein the maintenance unit comprises an application unit which applies a bias of the same polarity as a toner charge polarity to a member in contact with the first surface image transferred onto said recording medium between an installation position of the first transfer unit and an installation position of the second transfer unit.

13. The image formation device according to claim 1, wherein the second transfer unit transfers without contact with the first surface of said recording medium.

14. The image formation device according to claim 1, wherein the image formation device further comprises a transfer fixation unit which executes fixation simultaneously with transfer of at least one of the first and second transfer units.

15. The image formation device according to claim 1, wherein the image formation device further comprises first and second fixation units each executing fixation immediately after completing a transfer of the first and second transfer units, and an amount of heat provided to a paper by the first fixation unit is set at an amount smaller than an amount of heat provided to said recording medium by the second fixation unit.

16. The image formation device according to claim 15, wherein the amount of heat in the first fixation unit is set in a range in which a cold offset is not caused.

17. The image formation device according to claim 15, wherein the first fixation unit comprises a fixation device that includes a heating member, comprising:

a heat generating member;

a film in contact with said heating member; and a pressuring member in contact with said heating member with pressure via said film, for heating and fixation by passing the recording medium with an unfixed image formed thereon between said film and said pressuring member.

18. The image formation device according to claim 1, wherein the image formation device further comprises:

a tip end resist unit which aligns a predetermined position in a conveyance direction of said recording medium to be conveyed into the second transfer unit with an image tip end of the second surface image.

19. The image formation device according to claim 1, wherein the image formation device further comprises a lateral resist adjusting unit which adjusts a position of said recording medium in a direction orthogonal to a conveyance direction between the first transfer unit and the second transfer unit.

20. The image formation device according to claim 1, wherein a conveyance path for passage of said recording medium is set in at least one of the first transfer unit and the second transfer unit at the time of forming each of said first and second surface images.

21. The image formation device according to claim 1, wherein an interval between the first surface image and the second surface image is at least (the time necessary for inversion of the recording medium)×(the moving speed of the image supporting member).

22. The image formation device according to claim 1, wherein a conveyance speed of the recording medium to be conveyed to the second transfer unit after the image transfer by the first transfer unit is set at a speed higher than a linear speed of the image supporting member in a rotational direction.

23. The image formation device according to claim 1, wherein at least one of the first and second transfer units transfers the image along a belt-like shape.

24. The image formation device according to claim 1, wherein an outer circumference of said image supporting member is at least a length of {(the first surface image length)+(the second surface image length)+(inverting time by the inverting unit)×(image supporting member speed) }, and wherein images to be transferred onto the front and back sides of said recording medium are first and second surface images, the first surface image is transferred onto the first surface of said recording medium by the first transfer unit, and the second surface image is transferred onto the second surface of said recording medium, respectively.

25. The image formation device according to claim 1, wherein said image supporting member comprises one of a photosensitive member and an intermediate transfer member.

26. The image formation device according to claim 1, wherein said image supporting member is formed in a drum-like shape.

27. The image formation device according to claim 1, wherein the image formation device further comprises a transfer fixation unit executing each fixation simultaneously with transfer of at least one of the first and second transfer units.

28. The image formation device according to claim 1, wherein the image formation device further comprises:

first and second fixation units each executing fixation immediately after completing a transfer of the first and second transfer unit; and an amount of heat provided to a paper by the first fixation unit is set at an amount smaller than an amount of heat provided to said recording medium by the second fixation unit.

29. The image formation device according to claim 28, wherein the amount of heat in the first fixation unit is set in a range in which a cold offset is not caused.

30. The image formation device according to claim 28, wherein the first fixation unit comprises a fixation device that includes a heating member, comprising:

a heat generating member;

a film in contact with said heating member; and a pressuring member in contact with said heating member with pressure via said film, for heating and fixation by passing the recording medium with an unfixed image formed thereon between said film and said pressuring member.

31. The image formation device according to claim 1, wherein the image formation device further comprises a cooling unit which cools said image supporting member.

32. The image formation device according to claim 1, wherein the image formation device further comprises an interleaf mechanism.

33. The image formation device according to claim 1, wherein said image supporting member is formed in a belt-like shape.

34. An image formation device for forming an image on an image supporting member by an image formation unit, comprising:

first and second transfer units which transfer an image formed on the same image supporting member to a recording medium having front and back sides; and an inverting unit which inverts the front and back sides of said recording medium by an inverting path while conveying said recording medium from the first transfer unit to the second transfer unit, the inverting unit including a branched nail and conveyance rollers, wherein the image formation unit comprises:

a latent image formation unit which forms an electrostatic latent image; and a developing unit which visualizes the formed electrostatic latent image with a liquid developing agent containing a toner as a visualizing particle dispersed in a liquid solvent.

35. The image formation device according to claim 34, wherein said liquid developing agent has a characteristic to be cured by a predetermined physical function.

36. The image formation device according to claim 35, wherein the predetermined physical function is an optical function.

37. The image formation device according to claim 34, wherein the image formation unit includes an intermediate transfer unit which transfers the visualized image developed by the developing unit onto an intermediate transfer member.

38. The image formation device according to claim 37, wherein one or more image producing units are in contact with said intermediate transfer member.

39. The image formation device according to claim 38, wherein one or more photosensitive members are contacted with the intermediate transfer member for executing said intermediate transfer.

40. The image formation device according to claim 39, wherein the developing unit is one or more developing units for each of said one or more photosensitive members for executing a developing operation.

41. The image formation device according to claim 34, wherein further the image formation unit forms first and second surface images, the first transfer unit transfers the first surface image onto a first surface of said recording medium, the second transfer unit transfers the second surface image onto a second surface of said recording medium inverted by the inverting unit, and a predetermined physical function hardens the first surface image transferred by the first transfer unit onto the first surface of said recording medium.

42. The image formation device according to claim 41, wherein the first transfer unit comprises a non-contact transfer unit which transfers only the first surface image onto the first surface of said recording medium without influencing the second surface image.

43. The image formation device according to claim 41, wherein the first transfer unit is configured to be separable from the image supporting member after the first surface image is- transferred onto the first surface of said recording medium from the image supporting member while the second surface image passes by a position of said first transfer unit.

44. The image formation device according to claim 41, wherein the image formation device further comprises a maintenance unit which maintains the first surface image transferred onto the first surface of said recording medium by the first transfer unit on said first surface and prevents disturbance at the time of inverting the recording medium.

45. The image formation device according to claim 44, wherein the maintenance unit comprises a heating fixation unit which fixes the first surface image of said recording medium.

46. The image formation device according to claim 45, wherein the maintenance unit further comprises an application unit which applies a bias of the same polarity as a toner charge polarity to a member in contact with the first surface image transferred onto said recording medium between an installation position of the first transfer unit and an installation position of the second transfer unit.

47. The image formation device according to claim 41, wherein the second transfer unit comprises a transfer unit which transfers without contact with the first surface of said recording medium.

48. The image formation device according to claim 41, wherein the image formation device further comprises:

a tip end resist unit which aligns a predetermined position in the conveyance direction of said recording medium to be conveyed into the second transfer unit with an image tip end of the second surface image.

49. The image formation device according to claim 41, wherein the image formation device further comprises a lateral resist adjusting unit which adjusts a position of said recording medium in a direction orthogonal to a conveyance direction between the first transfer unit and the second transfer unit.

50. The image formation device according to claim 41, wherein a conveyance path for passage of said recording medium is set in at least one of the first transfer unit and the second transfer unit at the time of forming each of said first and second surface images.

51. The image formation device according to claim 41, wherein an interval between the first surface image and the second surface image is at least (the time necessary for inversion of the recording medium)×(the moving speed of the image supporting member).

52. The image formation device according to claim 41, wherein a conveyance speed of the recording medium to be conveyed to the second transfer unit after the image transfer by the first transfer unit is set at a speed higher than a linear speed of the image supporting member in a rotational direction.

53. The image formation device according to claim 41, wherein at least one of the first and second transfer units transfers the image along a belt-like shape.

54. The image formation device according to claim 41, wherein a substance having a surface energy lower than the surface energy of the liquid developing agent is coated on a member to be contacted with the first surface image transferred onto said recording medium, between an installation position of the first transfer unit and an installation position of the second transfer unit.

55. The image formation device according to claim 34, wherein the liquid solvent of said liquid developing agent is volatile.

56. The image formation device according to claim 34, wherein the liquid solvent of said liquid developing agent is permeable to the recording medium.

57. The image formation device according to claim 34, wherein the developing unit includes one or more developing members.

58. An image formation method for forming an image on an image supporting member by an image formation unit, comprising:

forming a plurality of images on said image supporting member;

first transferring an image on said image supporting member on a first surface of a recording medium;

inverting front and back sides of the recording medium using a branched nail and conveyance rollers with the image transferred onto said first surface at the first transferring;

second transferring another image on said image supporting member onto a second surface of said recording medium with front and back sides inverted at the inverting; and maintaining the image transferred onto the first surface of said recording medium and preventing disturbance at the time of inverting the recording medium.

59. The image formation method according to claim 58, wherein a different image can be formed between said image transferred onto said first surface and said another image.

60. An image formation system comprising:

an inputting device for inputting image data; and an image formation device for forming an image based on the inputted image data, wherein the image formation device comprises an interleaf mechanism and an image information memory unit which accumulates the inputted image data for at least one screen, wherein the image formation device forms an image on an image supporting member by an image formation unit that includes:

first and second transfer units which transfer an image formed on the same image supporting member to a recording medium, an inverting unit which inverts front and back sides of said recording medium by an inverting path while conveying said recording medium from the first transfer unit to the second transfer unit, wherein the image formation unit forms first and second surface images, the first transfer unit transfers the first surface image onto a first surface of said recording medium, and the second transfer unit transfers the second surface image onto a second surface of said recording medium inverted by the inverting unit; and a maintenance unit which maintains the first surface image transferred onto the first surface of said recording medium by the first transfer unit and prevents disturbance at the time of inverting the recording medium.

61. An image formation system comprising:

an inputting device for inputting image data, wherein the inputting device includes an image reading device for optically reading a manuscript having two surfaces, and an image formation device for forming an image based on the inputted image data, wherein the image formation device forms an image on an image supporting member by an image formation unit that includes:

first and second transfer units which transfer an image formed on the same image supporting member to a recording medium;

an inverting unit which inverts front and back sides of said recording medium by an inverting path while conveying said recording medium from the first transfer unit to the second transfer unit, the inverting unit including a branched nail and conveyance rollers, wherein a time for reading the two surfaces of the manuscript of said image reading device is set to at most a time for exposing dual sided images on the image supporting member, the image formation unit forms first and second surface images, the first transfer unit transfers the first surface image onto a first surface of said recording medium, and the second transfer unit transfers the second surface image onto a second surface of said recording medium inverted by the inverting unit; and a maintenance unit which maintains the first surface image transferred onto the first surface of said recording medium by the first transfer unit and prevents disturbance at the time of inverting the recording medium.

62. An image formation device for forming an image on an image supporting member by an image formation unit, comprising:

first and second transfer units which transfer an image formed on the same image supporting member to a recording medium having front and back sides; and an inverting unit which inverts the front and back sides of said recording medium by an inverting path while conveying said recording medium from the first transfer unit to the second transfer unit, wherein the image formation unit comprises:

a latent image formation unit which forms an electrostatic latent image, a developing unit which develops the formed electrostatic latent image with a toner as a developing particle, and an intermediate transfer member, wherein the first transfer unit transfers the electrostatic latent image developed by the developing unit onto an intermediate transfer member unit.

63. An image formation device for forming an image on an image supporting member by an image formation unit, comprising:

first and second transfer units which transfer an image formed on the same image supporting member to a recording medium having front and back sides;

an inverting unit which inverts the front and back sides of said recording medium by an inverting path while conveying said recording medium from the first transfer unit to the second transfer unit, wherein the image formation unit forms first and second surface images, the first transfer unit transfers the first surface image onto a first surface of said recording medium, and the second transfer unit transfers the second surface image onto a second surface of said recording medium inverted by the inverting unit; and a maintenance unit which maintains the first surface image transferred onto the first surface of said recording medium by the first transfer unit and prevents disturbance at the time of inverting the recording medium, wherein the image formation unit comprises:

a latent image formation unit which forms an electrostatic latent image, and one or more developing units which develop the formed electrostatic latent image with a toner as a developing particle.

64. An image formation device for forming an image on an image supporting member by an image formation unit, comprising:

first and second transfer units which transfer an image formed on the same image supporting member to a recording medium having front and back sides;

an inverting unit which inverts the front and back sides of said recording medium by an inverting path while conveying said recording medium from the first transfer unit to the second transfer unit, wherein the image formation unit forms first and second surface images, the first transfer unit transfers the first surface image onto a first surface of said recording medium, and the second transfer unit transfers the second surface image onto a second surface of said recording medium inverted by the inverting unit; and a maintenance unit which maintains the first surface image transferred onto the first surface of said recording medium by the first transfer unit and prevents disturbance at the time of inverting the recording medium, wherein the image formation unit is configured to form an image by one of jetting a charged toner, or selectively adhering a thin layer of a magnetic toner.

65. An image formation device for forming an image on an image supporting member by an image formation unit, comprising:

first and second transfer units which transfer an image formed on the same image supporting member to a recording medium having front and back sides;

an inverting unit which inverts the front and back sides of said recording medium by an inverting path while conveying said recording medium from the first transfer unit to the second transfer unit; and a transfer fixation unit which executes fixation simultaneously with transfer of at least one of the first and second transfer units, wherein the image formation unit forms first and second surface images, the first transfer unit transfers the first surface image onto a first surface of said recording medium, and the second transfer unit transfers the second surface image onto a second surface of said recording medium inverted by the inverting unit.

66. An image formation device for forming an image on an image supporting member by an image formation unit, comprising:

first and second transfer units which transfer an image formed on the same image supporting member to a recording medium having front and back sides;

an inverting unit which inverts the front and back sides of said recording medium by an inverting path while conveying said recording medium from the first transfer unit to the second transfer unit; and first and second fixation units each executing fixation immediately after completing a transfer of the first and second transfer units, wherein the image formation unit forms first and second surface images, the first transfer unit transfers the first surface image onto a first surface of said recording medium, and the second transfer unit transfers the second surface image onto a second surface of said recording medium inverted by the inverting unit, a thermal amount provided to a paper by the first fixation unit is set at an amount smaller than a thermal amount provided to said recording medium by the second fixation unit.

67. An image formation device for forming an image on an image supporting member by an image formation unit, comprising:

first and second transfer units which transfer an image formed on the same image supporting member to a recording medium having front and back sides;

an inverting unit which inverts the front and back sides of said recording medium by an inverting path while conveying said recording medium from the first transfer unit to the second transfer unit, wherein the image formation unit forms first and second surface images, the first transfer unit transfers the first surface image onto a first surface of said recording medium, and the second transfer unit transfers the second surface image onto a second surface of said recording medium inverted by the inverting unit;

a tip end resist unit which matches a predetermined position in a conveyance direction of said recording medium to be conveyed into the second transfer unit with and an image tip end of the second surface image.

68. An image formation device for forming an image on an image supporting member by an image formation unit, comprising:

first and second transfer units which transfer an image formed on the same image supporting member to a recording medium having front and back sides;

an inverting unit which inverts the front and back sides of said recording medium by an inverting path while conveying said recording medium from the first transfer unit to the second transfer unit; and a lateral resist adjusting unit which matches said recording medium in a direction orthogonal to a conveyance direction between the first transfer unit and the second transfer unit, wherein the image formation unit forms first and second surface images, the first transfer unit transfers the first surface image onto a first surface of said recording medium, and the second transfer unit transfers the second surface image onto a second surface of said recording medium inverted by the inverting unit.

69. An image formation device for forming an image on an image supporting member by an image formation unit, comprising:

first and second transfer units which transfer an image formed on the same image supporting member to a recording medium having front and back sides; and an inverting unit which inverts the front and back sides of said recording medium by an inverting path while conveying said recording medium from the first transfer unit to the second transfer unit, wherein the image formation unit forms first and second surface images, the first transfer unit transfers the first surface image onto a first surface of said recording medium, and the second transfer unit transfers the second surface image onto a second surface of said recording medium inverted by the inverting unit, and wherein an interval between the first surface image and the second surface image is at least (the time necessary for inversion of the recording medium)×(the moving speed of the image supporting member).

70. An image formation device for forming an image on an image supporting member by an image formation unit, comprising:

first and second transfer units which transfer an image formed on the same image supporting member to a recording medium having front and back sides; and an inverting unit which inverts the front and back sides of said recording medium by an inverting path while conveying said recording medium from the first transfer unit to the second transfer unit, wherein the image formation unit forms first and second surface images, the first transfer unit transfers the first surface image onto a first surface of said recording medium, and the second transfer unit transfers the second surface image onto a second surface of said recording medium inverted by the inverting unit, and wherein a conveyance speed of the recording medium to be conveyed to the second transfer unit after the image transfer by the first transfer unit is set at a speed higher than a linear speed of the image supporting member in a rotational direction.

71. An image formation device for forming an image on an image supporting member by an image formation unit, comprising:

first and second transfer units which transfer an image formed on the same image supporting member to a recording medium having front and back sides; and an inverting unit which inverts the front and back sides of said recording medium by an inverting path while conveying said recording medium from the first transfer unit to the second transfer unit, wherein the image formation unit forms first and second surface images, the first transfer unit transfers the first surface image onto a first surface of said recording medium, and the second transfer unit transfers the second surface image onto a second surface of said recording medium inverted by the inverting unit, and wherein at least one of the first and second transfer units transfers the image along a belt.

72. An image formation device for forming an image on an image supporting member by an image formation unit, comprising:

first and second transfer units which transfer an image formed on the same image supporting member to a recording medium having front and back sides; and an inverting unit which inverts the front and back sides of said recording medium by an inverting path while conveying said recording medium from the first transfer unit to the second transfer unit, wherein the image formation unit comprises:

a latent image formation unit which forms an electrostatic latent image, and a developing unit which visualizes the formed electrostatic latent image with a liquid developing agent containing a toner as a visualizing particle dispersed in a liquid solvent, and wherein an image fixing is not performed between when a first image transferred to the image supporting member by the first transfer unit is transferred to the recording medium and when a second image transferred to the image supporting member by the second transfer unit is transferred to the recording medium.

73. An image formation device for forming an image on an image supporting member by an image formation unit, comprising:

first and second transfer units which transfer an image formed on the same image supporting member to a recording medium having front and back sides;

an inverting unit which inverts the front and back sides of said recording medium by an inverting path while conveying said recording medium from the first transfer unit to the second transfer unit; and first and second fixation units each executing fixation immediately after completing a transfer of the first and second transfer unit, wherein a thermal amount provided to a paper by the first fixation unit is set at an amount smaller than a thermal amount provided to said recording medium by the second fixation unit.

* * * * *